US009269366B2

(12) United States Patent
Chen et al.

(10) Patent No.: US 9,269,366 B2
(45) Date of Patent: Feb. 23, 2016

(54) HYBRID INSTANTANEOUS/DIFFERENTIAL PITCH PERIOD CODING

(75) Inventors: Juin-Hwey Chen, Irvine, CA (US); Hong-Goo Kang, Seoul (KR)

(73) Assignee: Broadcom Corporation, Irvine, CA (US)

( * ) Notice: Subject to any disclaimer, the term of this patent is extended or adjusted under 35 U.S.C. 154(b) by 740 days.

(21) Appl. No.: 12/847,101

(22) Filed: Jul. 30, 2010

(65) Prior Publication Data

US 2011/0029304 A1 Feb. 3, 2011

Related U.S. Application Data

(60) Provisional application No. 61/231,004, filed on Aug. 3, 2009.

(51) Int. Cl.

| | |
|---|---|
| ***G10L 19/00*** | (2013.01) |
| ***G10L 19/12*** | (2013.01) |
| ***G10L 19/22*** | (2013.01) |
| *G10L 19/08* | (2013.01) |

(52) U.S. Cl.

CPC ..... *G10L 19/22* (2013.01); *G10L 19/08* (2013.01)

(58) Field of Classification Search

CPC ..... G10L 19/00; G10L 19/002; G10L 19/005; G10L 19/0019; G10L 19/025; G10L 19/032; G10L 19/08; G10L 19/09; G10L 19/125; G10L 19/20; G10L 25/00; G10L 25/12; G10L 25/15; G10L 2019/0011; G10L 2019/00; G10L 2025/90

USPC ..... 704/200, 207, 208, 210, 500–504, 211, 704/214, 215

See application file for complete search history.

(56) References Cited

U.S. PATENT DOCUMENTS

| | | | | |
|---|---|---|---|---|
| 5,539,452 | A * | 7/1996 | Bush et al. | 348/14.13 |
| 5,657,418 | A * | 8/1997 | Gerson et al. | 704/207 |
| 5,749,064 | A | 5/1998 | Pawate et al. | |
| 5,828,994 | A | 10/1998 | Covell et al. | |
| 5,966,688 | A | 10/1999 | Nandkumar et al. | |
| 6,128,591 | A * | 10/2000 | Taori et al. | 704/214 |
| 6,154,499 | A * | 11/2000 | Bhaskar | H04L 1/0009 375/259 |
| 6,219,636 | B1 * | 4/2001 | Ihara | 704/207 |
| 6,415,252 | B1 * | 7/2002 | Peng et al. | 704/208 |
| 6,475,245 | B2 | 11/2002 | Gersho et al. | |
| 6,484,137 | B1 | 11/2002 | Taniguchi et al. | |
| 6,507,814 | B1 * | 1/2003 | Gao | 704/220 |
| 6,510,407 | B1 * | 1/2003 | Wang | 704/207 |
| 6,584,437 | B2 * | 6/2003 | Heikkinen et al. | 704/207 |

(Continued)

OTHER PUBLICATIONS

Eriksson et al., "Pitch quantization in low bit-rate speech coding", IEEE International Conference on Acoustics, Speech, and Signal Processing, vol. 1, Mar. 15-19, 1999, pp. 489-492.

(Continued)

*Primary Examiner* — Paras D Shah

(74) *Attorney, Agent, or Firm* — Fiala & Weaver P.L.L.C.

(57) ABSTRACT

A hybrid instantaneous/differential encoding technique is described herein that may be used to reduce the bit rate required to encode a pitch period associated with a segment of a speech signal in a manner that will result in relatively little or no degradation of a decoded speech signal generated using the encoded pitch period. The hybrid instantaneous/differential encoding technique is advantageously applicable to any speech codec that encodes a pitch period associated with a segment of a speech signal.

20 Claims, 15 Drawing Sheets

(56) References Cited

U.S. PATENT DOCUMENTS

| | | | | |
|---|---|---|---|---|
| 6,584,438 | B1 * | 6/2003 | Manjunath et al. | 704/207 |
| 6,625,226 | B1 | 9/2003 | Gersho et al. | |
| 6,687,666 | B2 * | 2/2004 | Ehara et al. | 704/207 |
| 6,691,082 | B1 | 2/2004 | Aguilar et al. | |
| 7,039,584 | B2 * | 5/2006 | Gournay et al. | 704/221 |
| 7,047,185 | B1 * | 5/2006 | Younes et al. | 704/201 |
| 7,171,355 | B1 | 1/2007 | Chen | |
| 7,272,556 | B1 | 9/2007 | Aguilar et al. | |
| 7,337,108 | B2 | 2/2008 | Florencio et al. | |
| 7,426,470 | B2 | 9/2008 | Chu et al. | |
| 7,478,042 | B2 * | 1/2009 | Ehara et al. | 704/233 |
| 7,747,430 | B2 * | 6/2010 | Makinen | 704/219 |
| 7,912,710 | B2 | 3/2011 | Sasaki et al. | |
| 7,917,357 | B2 | 3/2011 | Florencio et al. | |
| 7,957,960 | B2 | 6/2011 | Chen | |
| 8,032,360 | B2 | 10/2011 | Chen | |
| 8,078,456 | B2 | 12/2011 | Chen et al. | |
| 8,279,889 | B2 * | 10/2012 | Rajendran et al. | 370/465 |
| 8,321,216 | B2 | 11/2012 | Zopf | |
| 8,392,178 | B2 * | 3/2013 | Vos | 704/207 |
| 8,670,990 | B2 | 3/2014 | Chen et al. | |
| 2001/0018650 | A1 | 8/2001 | Dejaco | |
| 2002/0038209 | A1 | 3/2002 | Brandel et al. | |
| 2003/0033140 | A1 | 2/2003 | Taori et al. | |
| 2003/0200092 | A1 | 10/2003 | Gao et al. | |
| 2004/0167772 | A1 * | 8/2004 | Erzin | 704/207 |
| 2004/0172243 | A1 * | 9/2004 | Ramabadran | G10L 19/09 704/230 |
| 2004/0181753 | A1 | 9/2004 | Michaelides | |
| 2004/0267525 | A1 | 12/2004 | Lee et al. | |
| 2005/0066050 | A1 | 3/2005 | Dharamshi | |
| 2005/0228648 | A1 * | 10/2005 | Heikkinen | 704/205 |
| 2005/0254783 | A1 | 11/2005 | Chen | |
| 2006/0130637 | A1 * | 6/2006 | Crebouw | G10L 19/0204 84/603 |
| 2007/0094031 | A1 | 4/2007 | Chen | |
| 2007/0192092 | A1 | 8/2007 | Huang | |
| 2007/0219787 | A1 | 9/2007 | Manjunath et al. | |
| 2008/0052068 | A1 | 2/2008 | Aguilar et al. | |
| 2008/0162121 | A1 * | 7/2008 | Son et al. | 704/201 |
| 2008/0304678 | A1 | 12/2008 | Chen et al. | |
| 2010/0185442 | A1 * | 7/2010 | Sato | G10L 25/90 704/222 |
| 2011/0029317 | A1 | 2/2011 | Chen et al. | |
| 2011/0125505 | A1 * | 5/2011 | Vaillancourt et al. | 704/500 |
| 2011/0208517 | A1 | 8/2011 | Zopf | |

OTHER PUBLICATIONS

Chen et al., "The Broadvoice Speech Coding Algorithm", IEEE International Conference on Acoustics, Speech and Signal Processing, vol. 4, Apr. 15- 20, 2007, 4 pages.

* cited by examiner

HYBRID INSTANTANEOUS/DIFFERENTIAL PITCH PERIOD CODING

CROSS-REFERENCE TO RELATED APPLICATIONS

This application claims priority to U.S. Provisional Patent Application No. 61/231,004, filed Aug. 3, 2009 and entitled "Methods and Systems for Multi-Mode Variable-Bit-Rate Speech Coding," the entirety of which is incorporated by reference herein.

BACKGROUND OF THE INVENTION

1. Field of the Invention

The present invention generally relates to systems that encode audio signals, such as speech signals, for transmission or storage and/or that decode encoded audio signals for playback.

2. Background

Speech coding refers to the application of data compression to audio signals that contain speech, which are referred to herein as "speech signals." In speech coding, a "coder" encodes an input speech signal into a digital bit stream for transmission or storage, and a "decoder" decodes the bit stream into an output speech signal. The combination of the coder and the decoder is called a "codec." The goal of speech coding is usually to reduce the encoding bit rate while maintaining a certain degree of speech quality. For this reason, speech coding is sometimes referred to as "speech compression" or "voice compression."

The encoding of a speech signal typically involves applying signal processing techniques to estimate parameters that model the speech signal. In many coders, the speech signal is processed as a series of time-domain segments, often referred to as "frames" or "sub-frames," and a new set of parameters is calculated for each segment. Data compression algorithms are then utilized to represent the parameters associated with each segment in a compact bit stream. Different codecs may utilize different parameters to model the speech signal. By way of example, the BROADVOICE16™ ("BV16") codec, which is described by J.-H. Chen and J. Thyssen in "The BroadVoice Speech Coding Algorithm," Proceedings of 2007 IEEE International Conference on Acoustics, Speech and Signal Processing, pp. IV-537-IV-540, April 2007, is a two-stage noise feedback codec that encodes Line-Spectrum Pair (LSP) parameters, a pitch period, three pitch taps, excitation gain and excitation vectors associated with each 5 ms frame of an audio signal. Other codecs may encode different parameters.

As noted above, the goal of speech coding is usually to reduce the encoding bit rate while maintaining a certain degree of speech quality. There are many practical reasons for seeking to reduce the encoding bit rate. Motivating factors may include, for example, the conservation of bandwidth in a two-way speech communication scenario or the reduction of memory requirements in an application that stores encoded speech for subsequent playback. To this end, codec designers are often tasked with reducing the number of bits required to encode a parameter associated with a segment of a speech signal without sacrificing too much in terms of the resulting quality of the decoded speech signal.

Like the BV16 codec mentioned above, many speech codecs in use today encode a pitch period associated with each segment of a speech signal. Generally speaking, a pitch period is a measure of the lag between repeating cycles of a quasi-periodic or periodic signal. The pitch period is an important parameter for speech coding because voiced regions of a speech signal are often periodic in nature and thus can be modeled by estimating a pitch period associated therewith. The pitch period of a voiced region of a speech signal typically does not change abruptly but rather evolves smoothly over time. The pitch period is often used in codecs that perform long-term prediction of a speech signal.

In the BV16 codec, the encoder uses 7-bit instantaneous uniform quantization to generate a quantized representation of a pitch period that may range from 10 samples to 136 samples for each 5 ms frame. (As used herein, the term "instantaneous" quantization means that the quantization is based solely on that particular parameter or sample being quantized in an instantaneous manner without delayed-decision coding and without relying on previous states (memory)). This means that in BV16, pitch period encoding consumes 1400 bits per second (bps) of the total 16 kb/s encoding bit rate, or less than 10% of the total encoding bit rate. While this is a relatively small amount of the total encoding bit rate, if the same pitch period encoding method were used in a codec having a significantly lower encoding bit rate, the percentage consumed would be much higher. For example, if the same pitch period encoding method were to be used in a codec that was required to have a 4 kb/s-5 kb/s encoding bit rate, the pitch period encoding method would consume roughly a third of the available bit rate.

One obvious approach to reducing the encoding bit rate associated with BV16 would be to simply reduce the fixed number of bits used to generate the quantized representation of the pitch period, either by narrowing the range of pitch periods represented, by reducing the number of levels represented, or both. However, this approach would tend to result in a corresponding degradation of the decoded speech signal generated by the BV16 decoder, which would be forced to decode the speech signal with more limited and/or less accurate pitch period data.

What is needed, then, are systems and methods for reducing the bit rate required to encode a pitch period associated with a segment of a speech signal in a manner that will result in relatively little or no degradation of a decoded speech signal generated using the encoded pitch period. The desired systems and method should be applicable to the BV16 codec or any other speech codec that encodes a pitch period associated with a segment of a speech signal.

BRIEF SUMMARY OF THE INVENTION

A hybrid instantaneous/differential encoding technique is described herein that may be used to reduce the bit rate required to encode a pitch period associated with a segment of a speech signal in a manner that will result in relatively little or no degradation of a decoded speech signal generated using the encoded pitch period. The hybrid instantaneous/differential encoding technique is advantageously applicable to the BV16 codec or any other speech codec that encodes a pitch period associated with a segment of a speech signal.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS/FIGURES

The accompanying drawings, which are incorporated herein and form part of the specification, illustrate the present invention and, together with the description, further serve to explain the principles of the invention and to enable a person skilled in the relevant art(s) to make and use the invention.

Figure 1:
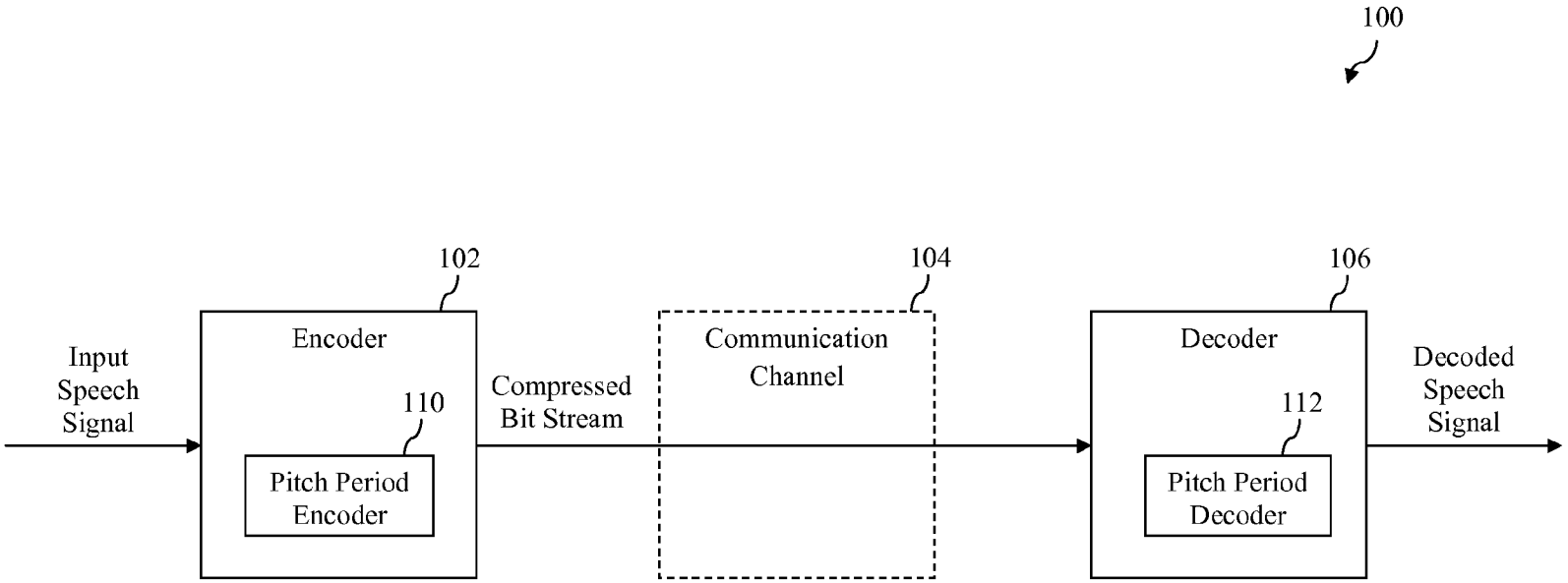
FIG. 1 is a block diagram of a system that performs speech coding in support of real-time speech communication, wherein a speech encoder and decoder of the system collectively implement a hybrid instantaneous/differential pitch period coding scheme in accordance with an embodiment of the present invention.

The features and advantages of the present invention will become more apparent from the detailed description set forth below when taken in conjunction with the drawings, in which like reference characters identify corresponding elements throughout. In the drawings, like reference numbers generally indicate identical, functionally similar, and/or structurally similar elements. The drawing in which an element first appears is indicated by the leftmost digit(s) in the corresponding reference number.

DETAILED DESCRIPTION OF THE INVENTION

A. Introduction

The following detailed description refers to the accompanying drawings that illustrate exemplary embodiments consistent with this invention. Other embodiments are possible, and modifications may be made to the embodiments within the spirit and scope of the present invention. Therefore, the following detailed description is not meant to limit the invention. Rather, the scope of the invention is defined by the appended claims.

References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to implement such feature, structure, or characteristic in connection with other embodiments whether or not explicitly described.

B. Example Systems in Accordance with Embodiments of the Present Invention

Exemplary systems that implement a hybrid instantaneous/differential pitch period encoding scheme in accordance with an embodiment of the present invention will now be described. These systems have been described herein by way of example only and are not intended to limit the present invention. Persons skilled in the relevant art(s) will readily appreciate that the hybrid instantaneous/differential pitch period encoding scheme described herein may be implemented in system other than those described herein.

In particular, FIG. 1 is a block diagram of a system 100 that performs speech coding in support of real-time speech communication, wherein a speech encoder and decoder of the system collectively implement a hybrid instantaneous/differential pitch period coding scheme in accordance with an embodiment of the present invention. As shown in FIG. 1, system 100 includes an encoder 102 that receives an input speech signal and applies a speech encoding algorithm thereto to generate a compressed bit stream. As used herein, the term "speech signal" refers to an audio signal that contains speech. The compressed bit stream, which comprises an encoded representation of the input speech signal, is transmitted via a communication channel 104 to a decoder 106 in real-time. Decoder 106 receives the compressed bit stream and applies a speech decoding algorithm thereto to generate a decoded speech signal for playback. Taken together, encoder 102 and decoder 106 comprise a speech codec.

Encoder 102 processes the input speech signal as a series of discrete equally-sized time-domain segments. These segments may be referred to, for example, as "frames" or "subframes." Encoder 102 applies signal processing algorithms to the input speech signal to estimate parameters that model the signal. Encoder 102 generates a new set of parameters for each segment. Encoder 102 then applies data compression algorithms to represent the parameters associated with each segment as part of the compressed bit stream. One of the parameters generated for each segment of the input speech signal by encoder 102 is a pitch period.

As shown in FIG. 1, encoder 102 includes a pitch period encoder 110 that operates to encode a pitch period associated with each segment of the input speech signal. As will be discussed in more detail herein, pitch period encoder 110 operates to selectively encode the pitch period associated with each segment using either an instantaneous pitch period encoding method or a differential pitch period encoding method. In certain embodiments, the instantaneous pitch period encoding method uses more bits on average to encode the pitch period than the differential pitch period encoding method. Accordingly, by selectively using the differential pitch period encoding method for certain segments, pitch period encoder 110 will operate to reduce the overall bit rate associated with encoding the pitch period over time as compared to an implementation in which the pitch period is encoded using instantaneous pitch period encoding for every segment. Furthermore, as will also be discussed in more detail herein, by selectively using instantaneous pitch period encoding for certain segments, pitch period encoder 102 will also ensure that relatively little or no degradation of the decoded speech signal generated by decoder 106 results from using such a hybrid pitch period encoding approach.

As further shown in FIG. 1, decoder 106 includes a pitch period decoder 112 that operates to decode the encoded representation of the pitch period associated with each segment that is generated by encoder 102. To this end, decoder 106 is configured to determine, for each encoded representation of a segment received from encoder 102, whether the pitch period has been encoded using an instantaneous encoding method or a differential encoding method and to apply either an instantaneous pitch period decoding method or a differential pitch period decoding method based on the determination.

Additional details regarding the operation of encoder 102 and decoder 106 will be provided herein. Encoder 102 and decoder 106 may represent modified components of any of a wide variety of speech codecs that operate to encode and decode a pitch period in association with each segment of a speech signal. For example, and without limitation, encoder 102 and decoder 106 may represent modified components of either of the BROADVOICE16™ ("BV16") or BROADVOICE32™ ("BV32") speech codecs described by J.-H. Chen and J. Thyssen in "The BroadVoice Speech Coding Algorithm," Proceedings of 2007 IEEE International Conference on Acoustics, Speech and Signal Processing, pp. IV-537-IV-540, April 2007, the entirety of which is incorporated by reference herein. As another example, encoder 102 and decoder 106 may represent modified components of any of a wide variety of Code Excited Linear Prediction (CELP) codecs that operate to encode and decode a pitch period in association with each segment of a speech signal. However, these examples are not intended to be limiting and persons skilled in the relevant art(s) will appreciate that the hybrid instantaneous/differential pitch period coding methods described herein may be implemented in other speech or audio codecs.

Although system 100 shows only one encoder on one side of communication channel 104 and one decoder on the other side of communication channel, persons skilled in the relevant art(s) will appreciate that in most real-time speech communication scenarios, an encoder and a decoder (i.e., a codec) are provided on both sides of the communication channel to enable two-way communication. Although this additional encoder-decoder pair has not been shown in FIG. 1 for the sake of convenience, persons skilled in the relevant art(s) will appreciate that system 100 may include such components and that such components may also implement a hybrid instantaneous/differential pitch period coding method in accordance with the present invention.

Figure 2:
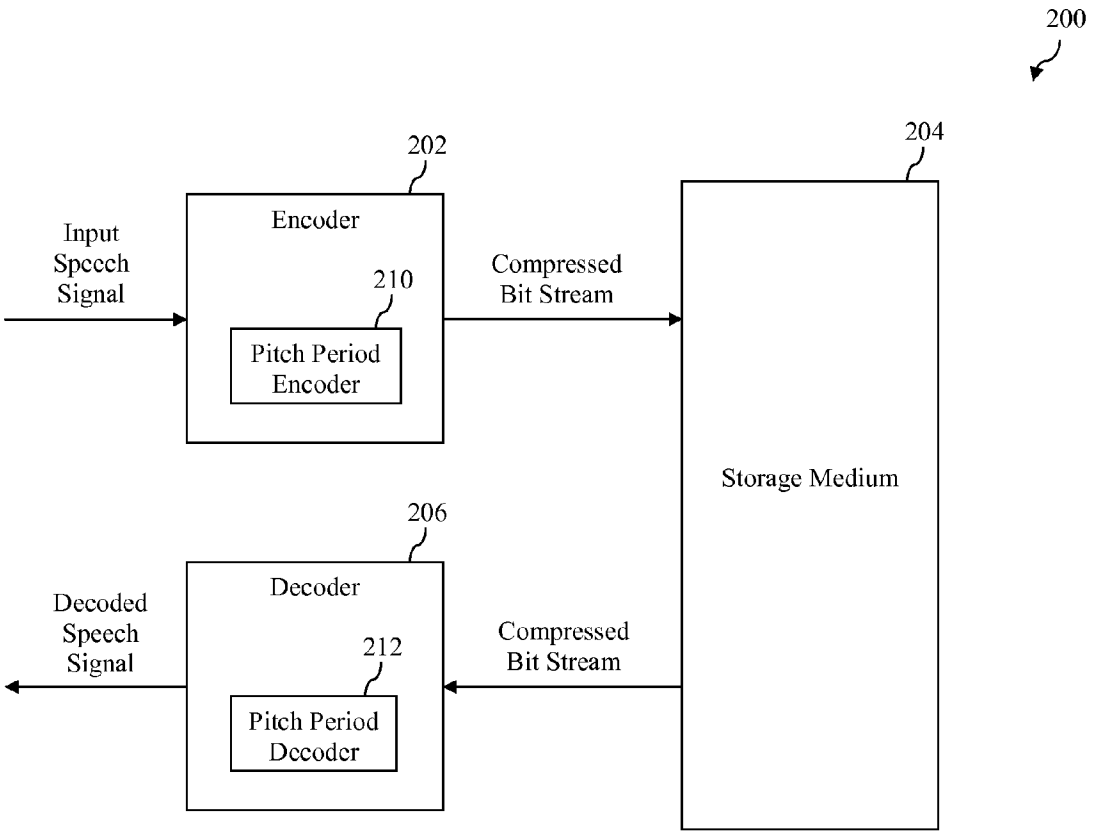
FIG. 2 is a block diagram of a system that performs speech coding in support of a speech storage application, wherein a speech encoder and decoder of the system collectively implement a hybrid instantaneous/differential pitch period coding scheme in accordance with an embodiment of the present invention.

FIG. 2 is a block diagram of another example system 200 that performs speech coding, wherein a speech encoder and decoder of the system collectively implement a hybrid instantaneous/differential pitch period coding scheme in accordance with an embodiment of the present invention. However, unlike system 100 which performs speech coding in support of real-time speech communication, system 200 performs speech coding in support of a speech storage application in which the encoded representation of the speech signal is stored in a storage medium for later play back. Examples of such speech storage applications include, but are not limited to, audio books, talking toys, and voice prompts stored in voice response systems, BLUETOOTH™ headsets or Personal Navigation Devices with BLUETOOTH™ telephony support.

As shown in FIG. 2, system 200 includes an encoder 202 that receives an input speech signal and applies a speech encoding algorithm thereto to generate a compressed bit stream. The compressed bit stream, which comprises an encoded representation of the input speech signal, is stored in a storage medium 204 and is later retrieved and provided to decoder 206. Decoder 206 receives the compressed bit stream and applies a speech decoding algorithm thereto to generate a decoded speech signal for playback. Taken together, encoder 202 and decoder 206 comprise a speech codec.

As shown in FIG. 2, encoder 202 includes a pitch period encoder 210 that operates to encode a pitch period associated with each segment of the input speech signal. Like pitch period encoder 110 described above in reference to FIG. 1, pitch period encoder 210 operates to selectively encode the pitch period associated with each segment using either an instantaneous pitch period encoding method or a differential pitch period encoding method. As further shown in FIG. 2, decoder 206 includes a pitch period decoder 212 that operates in a like manner to pitch period decoder 112 described above in reference to FIG. 1 to decode the encoded representation of the pitch period associated with each segment that is generated by encoder 202. To this end, decoder 206 is configured to determine, for each encoded representation of a segment retrieved from storage medium 204, whether the pitch period has been encoded using an instantaneous encoding method or a differential encoding method and to apply either an instantaneous pitch period decoding method or a differential pitch period decoding method based on the determination.

Additional details regarding the operation of encoder 202 and decoder 206 will be provided herein. Taken together, encoder 202 and decoder 206 may represent modified components of any of a wide variety of speech codecs that operate to encode and decode a pitch period in association with each segment of a speech signal, including but not limited to the BV16 and BV32 speech codecs or any of a variety of well-known CELP codecs.

C. Example Encoder in Accordance with Embodiments of the Present Invention

Figure 3:
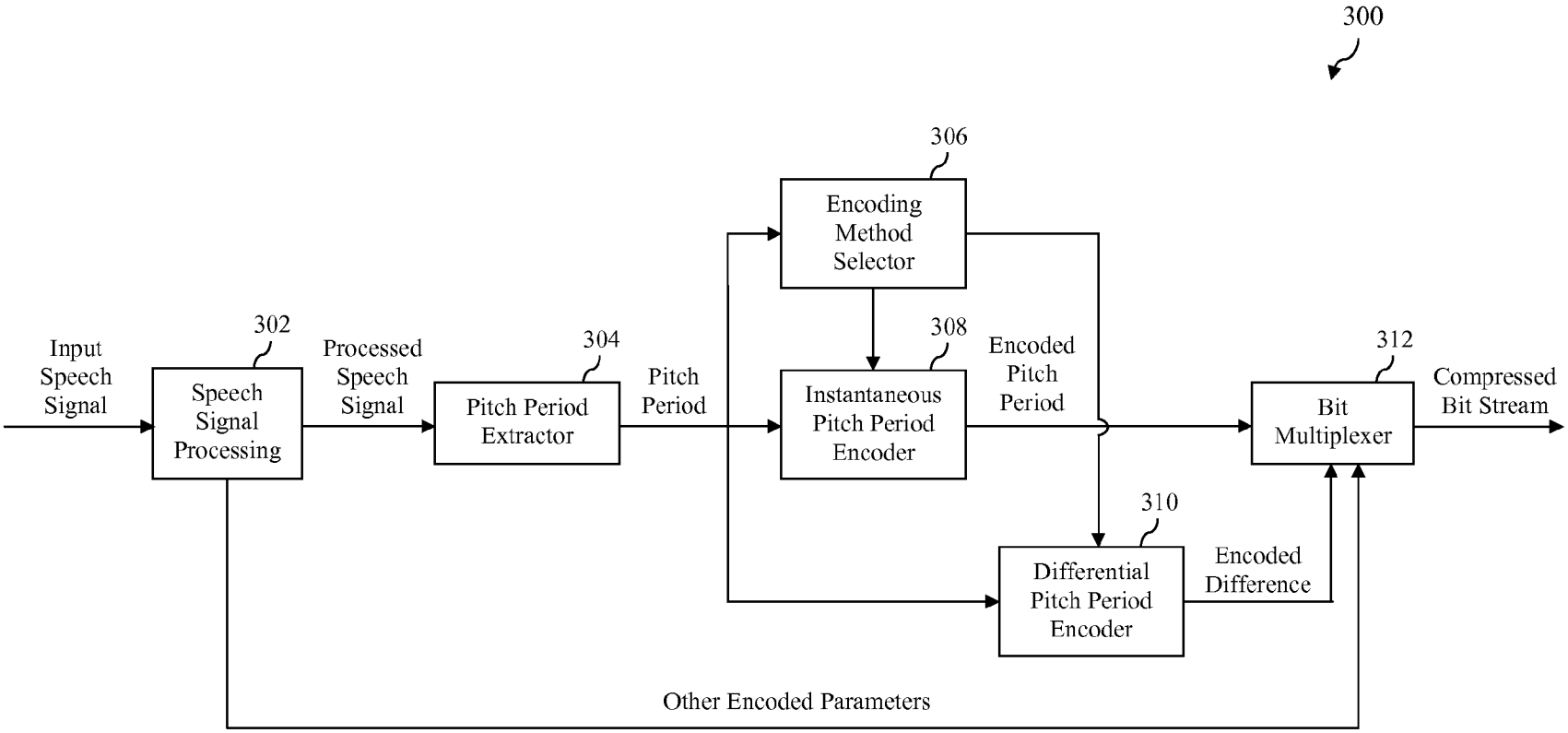
FIG. 3 is a block diagram of an example encoder that implements a hybrid instantaneous/differential pitch period encoding scheme in accordance with an embodiment of the present invention.

FIG. 3 is a block diagram of an example encoder 300 that implements a hybrid instantaneous/differential pitch period encoding scheme in accordance with an embodiment of the present invention. Generally speaking, encoder 300 is configured to receive an input speech signal, to apply signal processing methods thereto to obtain a set of parameters that model the input speech signal on a segment-by-segment basis (e.g., on a frame-by-frame or sub-frame-by-sub-frame basis), and to apply data compression to the parameters obtained for each segment to generate a compressed bit stream for transmission or storage. Encoder 300 may represent an implementation of encoder 102 as described above in reference to system 100 of FIG. 1 or encoder 202 as described above in reference to system 200 of FIG. 2, although these are only examples.

As shown in FIG. 3, encoder 300 includes a plurality of interconnected components, including a speech signal processing module 302, a pitch period extractor 304, an encoding method selector 306, an instantaneous pitch period encoder 308, a differential pitch period encoder 310 and a bit multiplexer 312. Each of these components may be implemented in software, through the execution of instructions by one or more general purpose or special-purpose processors, in hardware, using analog and/or digital circuits, or as a combination of software and hardware. Each of these components will now be described.

Speech signal processing module 302 is intended to represent the logic of encoder 300 that operates to obtain and encode all the parameters associated with each segment of the input speech signal with the exception of the pitch period. As will be appreciated by persons skilled in the relevant art(s), the structure, function and operation of speech signal processing module 302 will vary depending upon the codec design. In an example implementation in which encoder 300 comprises a modified version of a BV16 or BV32 encoder, speech signal processing module 302 may operate to obtain and encode Line-Spectrum Pair (LSP) parameters, three pitch taps, an excitation gain and excitation vectors associated with each 5 ms frame of the input speech signal. The encoded parameters generated by speech signal processing module 302 are provided to bit multiplexer 312.

Pitch period extractor 304 is configured to receive a processed version of the input speech signal from speech signal processing module 302 and to apply a pitch period extraction algorithm thereto to obtain an estimated pitch period for each segment of the processed speech signal. In an example implementation in which encoder 300 comprises a modified version of a BV16 or BV32 encoder, the processed speech signal received from speech signal processing module 302 may comprise a version of the input speech signal that has been passed through a high-pass pre-filter, a pre-emphasis filter, and from which predicted short-term signal components have been removed. In other codecs, the processed speech signal may represent some other processed version of the input speech signal. It is also possible that, in certain implementations, the processed speech signal is identical to the input speech signal—in other words, in certain implementations, pitch period extractor 304 may operate directly on the input speech signal rather than on a processed version thereof. Thus, although various portions of the description herein may state that pitch period extractor 304 operates on a processed version of the input speech signal, it is to be understood that the invention is not so limited.

A variety of well-known pitch extraction algorithms may be used to implement pitch period extractor 304. The pitch period generated for each segment is passed to encoding method selector 306, instantaneous pitch period encoder 308 and differential pitch period encoder 310.

Encoding method selector 306 is configured to receive the pitch period generated by pitch period extractor 304 for each segment of the processed speech signal and to use this information to decide, on a segment-by-segment basis, whether an instantaneous pitch period encoding method or a differential pitch period encoding method should be used to encode the pitch period associated with the current segment. If encoding method selector 306 selects the instantaneous pitch period encoding method, then encoding method selector 306 will invoke or otherwise activate instantaneous pitch period encoder 308 to apply an instantaneous coding method to encode the pitch period associated with the current segment while causing differential pitch period encoder 310 to remain inactive for the current segment. However, if encoding method selector 306 selects the differential pitch period encoding method, then encoding method selector 306 will invoke or otherwise activate differential pitch period encoder 310 to apply a differential coding method to encode the pitch period associated with the current segment while causing instantaneous pitch period encoder 308 to remain inactive for the current segment.

The different methods used by each of instantaneous pitch period encoder 308 and differential pitch period encoder 310 to encode the pitch period associated with a current segment of the processed speech signal will be described herein. In accordance with certain embodiments, instantaneous pitch period encoder 308 encodes the pitch period associated with the current segment to generate a quantized representation of the pitch period itself while differential pitch period encoder 310 generates an encoded representation of a difference between the pitch period associated with the current segment and a pitch period associated with a segment that immediately precedes the current segment. Thus, depending upon the decision made by encoding method selector 306 for the current segment, either the encoded pitch period produced by instantaneous pitch period encoder 308 or the encoded difference produced by differential pitch period encoder 310 will be provided to bit multiplexer 312.

Bit multiplexer 312 operates on a segment-by-segment basis to combine the encoded parameters received from speech signal processing module 302 and either the encoded pitch period produced by instantaneous pitch period encoder 308 or the encoded difference produced by differential pitch period encoder 310 to produce a compressed encoded representation of each segment of the input speech signal. Bit multiplexer 312 also includes in the encoded representation of each segment one or more bits that indicate which pitch period encoding method was used for that segment. This encoded representation is then transmitted or stored as part of a compressed bit stream generated by bit multiplexer 312.

Figure 4:
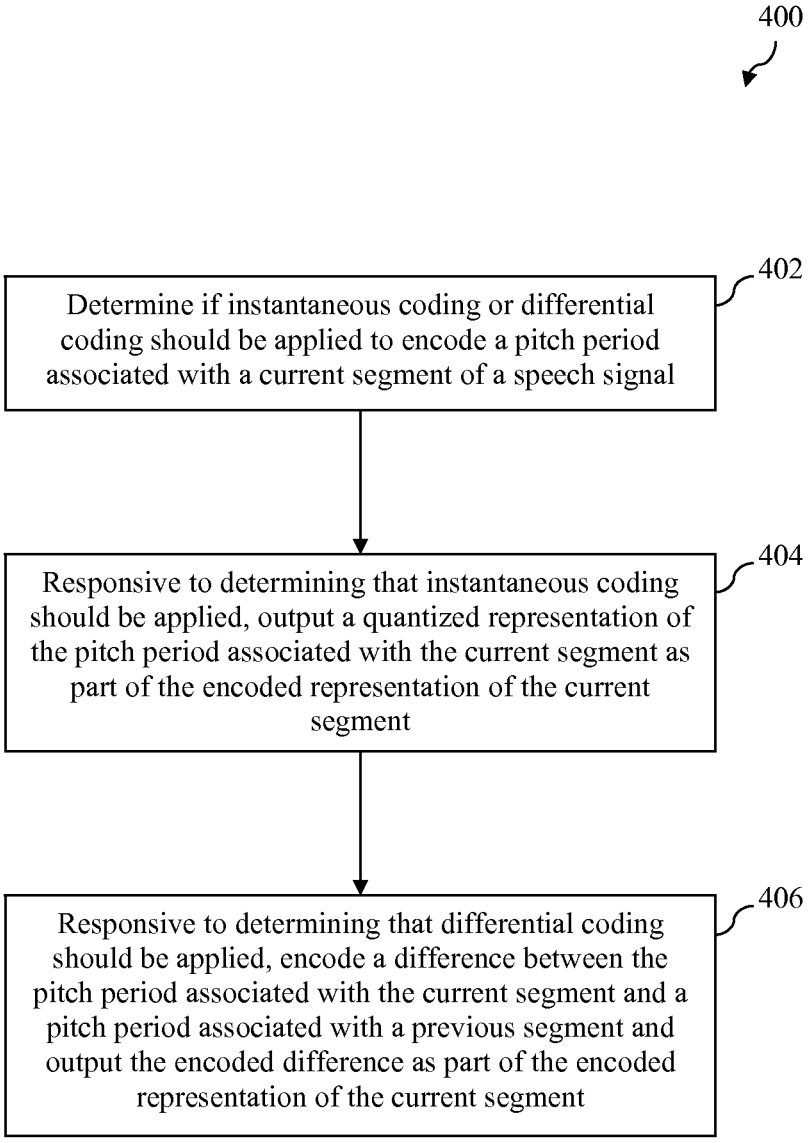
FIG. 4 depicts a flowchart of one method for performing hybrid instantaneous/differential encoding of a pitch period associated with a segment of a speech signal in accordance with an embodiment of the present invention.

FIG. 4 depicts a flowchart 400 of one method for performing hybrid instantaneous/differential encoding of a pitch period associated with a segment of a speech signal in accordance with an embodiment of the present invention. The method of flowchart 400 may be implemented, for example, by encoder 300 of FIG. 3, although the method may be implemented in many other encoders as well.

As shown in FIG. 4, the method of flowchart 400 begins at step 402 in which a determination is made as to whether instantaneous coding or differential coding should be applied to encode a pitch period associated with a current segment of a speech signal. This step may be performed, for example, by encoding method selector 306 of encoder 300 as described above in reference to FIG. 3. Various methods for making such a determination will be described herein.

At step 404, responsive to a determination that instantaneous coding should be applied, a quantized representation of the pitch period associated with the current segment is output as part of the encoded representation of the current segment. This step may be performed, for example, by instantaneous pitch period encoder 308 and bit multiplexer 312 of encoder 300 as described above in reference to FIG. 3, wherein instantaneous pitch period encoder 308 generates the quantized representation of the pitch period and bit multiplexer 312 outputs the quantized representation of the pitch period as part of the encoded representation of the current segment.

In one embodiment, generating the quantized representation of the pitch period may comprise applying a uniform quantization scheme that uses a fixed number of bits to represent all the possible pitch periods in a particular pitch period range. For example, in an embodiment in which the encoder is a modified version of the BV16 encoder, generating a quantized representation of the pitch period may comprise applying a uniform quantization scheme that uses 7 bits to represent 127 possible pitch periods in a pitch period range of 10 samples to 136 samples (with one 7-bit codeword reserved for other purposes). However, this is only an example and numerous other methods for generating a quantized representation of the pitch period may be used.

At step 406, responsive to a determination that differential coding should be applied, a difference between the pitch period associated with the current segment and a pitch period associated with a previous segment is encoded and the encoded difference is output as part of the encoded representation of the current segment. This step may be performed, for example, by differential pitch period encoder 310 and bit multiplexer 312 of encoder 300 as described above in reference to FIG. 3, wherein differential pitch period encoder 310 generates the encoded representation of the difference and bit multiplexer 312 outputs the encoded representation of the difference as part of the encoded representation of the current segment.

In one embodiment, generating an encoded representation of the difference comprises using a fixed bit-rate quantization scheme to quantize the difference. In an embodiment in which fixed bit-rate quantization is also used for instantaneous encoding of the pitch period, the fixed number of bits used to represent the difference should be less than the fixed number of bits used to represent the pitch period to achieve an average encoding bit-rate reduction. Thus, with further reference to an example modified implementation of the BV16 encoder described above, fewer than 7 bits may be used to encode the difference. For example, 3 or 4 bits may be used to encode the difference.

In an alternate embodiment, generating an encoded representation of the difference comprises using a variable bit-rate entropy coding scheme to represent the difference. As will be appreciated by persons skilled in the relevant art(s), entropy coding is a coding scheme that assigns codewords of variable lengths to different quantizer codebook entries such that highly probable quantizer codebook entries are assigned shorter codewords, and less probably quantizer codebook entries are assigned longer codewords. If the probabilities of different quantizer codebook entries being selected are highly uneven, then the average encoding bit-rate can be reduced by using such an entropy coding scheme as opposed to a fixed-length coding scheme.

By way of further illustration, let $p(n)$ denote the pitch period of the n-th segment of the processed speech signal and let $d(n)=p(n)-p(n-1)$ be the difference between the pitch period associated with the n-th frame and the pitch period associated with the $(n-1)$-th frame. A histogram analysis of $d(n)$ has shown that when coding the pitch period of speech signals with a hybrid instantaneous/differential coding scheme in accordance with a particular embodiment of the present invention, the pitch period difference $d(n)$ has the following probability rank ordering: the case of $d(n)=0$ has the highest probability, $d(n)=1$ has the second highest probability, $d(n)=-1$ has the third highest probability, followed by $d(n)=2$, then by $d(n)=-2$, then by $d(n)=3$, and then $d(n)=-3$, and so on. To distinguish the variable-length codewords assigned to the different pitch period differences, the simple and well-know Huffman coding scheme may be adopted. Table 1 shows a proposed Huffman coding scheme. Note that by using this scheme, the Huffman decoder simply needs to count the number of leading 0s before the ending 1 to decide which pitch period difference was encoded.

TABLE 1

Example Bit Allocation for Huffman Coding of Pitch Period Difference

| Pitch period difference | Assigned code |
|---|---|
| 0 | 1 |
| 1 | 01 |
| −1 | 001 |
| 2 | 0001 |
| −2 | 00001 |
| 3 | 000001 |
| −3 | 0000001 |
| . . . | . . . |

Entropy coding schemes such as those described above are somewhat sensitive to bit errors. For example, if a channel error caused any of the 0s in the codes shown in Table 1 to be replaced with a 1, this could result in a significant decoding error. For this reason, an entropy coding scheme may be more optimally suited for use in a speech storage application, which is not susceptible to channel errors, than a real-time communication application such as telephony. However, the entropy coding scheme can be used for both.

If the difference between the pitch periods associated with two adjacent speech signal segments is large, then the differential coding scheme will need to allocate a large enough number of bits to adequately represent the difference. For example, in accordance with the Huffman coding scheme of Table 1, if the pitch period difference is 4, then 8 bits must be used to represent the difference. However, if on average the number of bits allocated to encoding the pitch period differentially exceeds the number of bits used to encode the pitch period instantaneously, no encoding bit rate reduction can be achieved using a hybrid approach. An embodiment of the present invention addresses this issue by encoding the pitch period associated with a current segment instantaneously if it is substantially different from the pitch period associated with the previous segment and by encoding the pitch period associated with the current segment differentially if it is close to the pitch period associated with the previous segment. This helps to ensure that large differences will not need to be represented using differential encoding.

Figure 5:
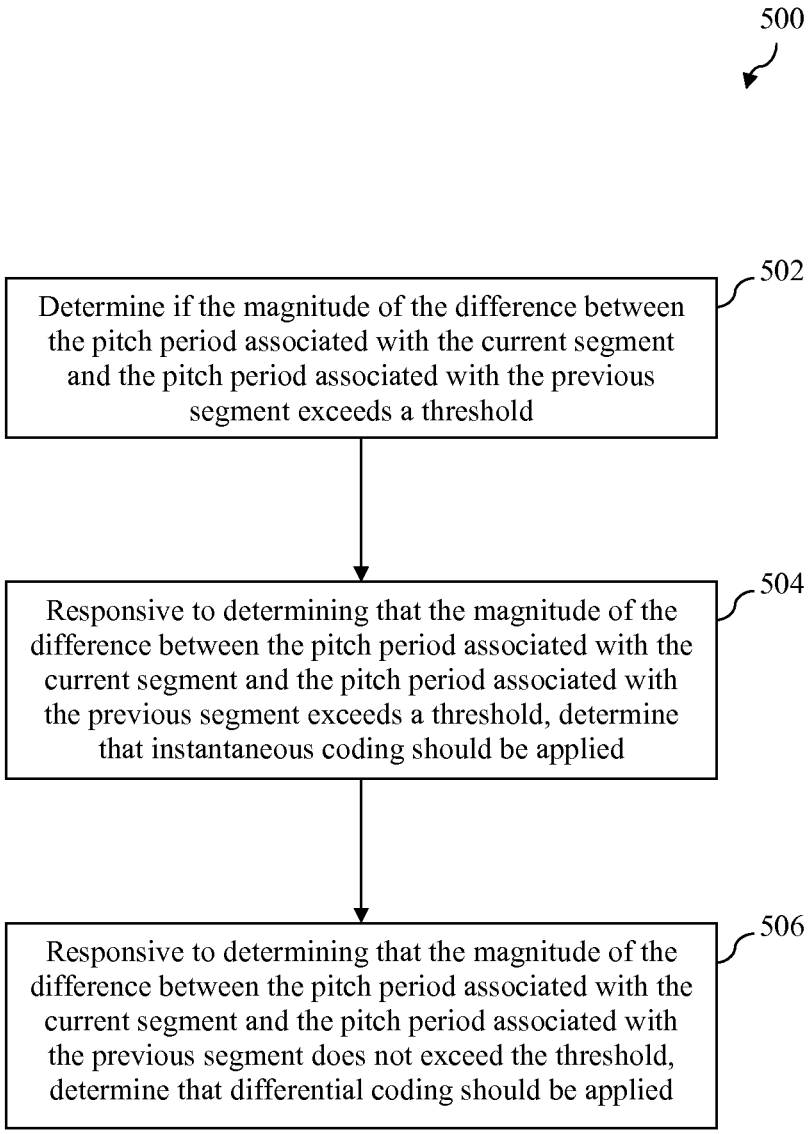
FIG. 5 depicts a flowchart of a method for determining if instantaneous coding or differential coding should be applied to encode a pitch period associated with a segment of a speech signal in accordance with an embodiment of the present invention.

FIG. 5 depicts a flowchart 500 of a method for determining if instantaneous coding or differential coding should be applied to encode a pitch period associated with a segment of a speech signal in accordance with such an approach. The method of flowchart 500 may be implemented, for example, by encoder 300 of FIG. 3, although the method may be implemented in many other encoders as well.

As shown in FIG. 5, the method of flowchart 500 begins at step 502, in which it is determined whether the magnitude of the difference between a pitch period associated with a current segment of a speech signal and a pitch period associated with a previous segment of the speech signal exceeds a threshold. Step 502 may comprise, for example, determining whether the magnitude of the difference exceeds a threshold such that it would require more bits to encode the difference differentially than it would instantaneously. For example, in an embodiment in which instantaneous coding of the pitch period is achieved using 7-bit uniform quantization and differential coding of the pitch period is achieved using the Huffman coding scheme shown in Table 1, this step may involve determining whether the magnitude of the difference is greater than 3, which would mean that 8 or more bits would be required to differentially encode the difference.

At step 504, responsive to determining that the magnitude of the difference between the pitch period associated with the current segment and the pitch period associated with the previous segment exceeds the threshold, it is determined that instantaneous coding should be applied to encode the pitch period associated with the current segment.

At step 506, responsive to determining that the magnitude of the difference between the pitch period associated with the current segment and the pitch period associated with the previous segment does not exceed the threshold, it is determined that differential coding should be applied to encode the pitch period associated with the current segment.

Each of the steps of flowchart 500 may be performed, for example, by encoding method selector 306 of encoder 300 as described above in reference to FIG. 3, as that component receives the pitch period associated with each segment from pitch period extractor 304 and is thus capable of determining the magnitude of the difference between pitch periods associated with adjacent segments.

In an alternate embodiment, the determination of whether the pitch period should be coded instantaneously or differentially is based not upon the magnitude of the difference between pitch periods associated with adjacent segments, but instead upon whether or not the current segment represents a first segment of a voiced speech region of the speech signal. Such an approach is useful in a multi-mode codec that encodes a pitch period only for voiced speech regions of the speech signal but does not encode a pitch period for silent or unvoiced speech regions of the speech signal. An example of such a multi-mode codec will be described below in Section E.

In the example multi-mode codec described in Section E, the encoder analyzes the speech signal and determines whether each segment of the speech signal comprises a silence segment, an unvoiced speech segment, a stationary voiced speech segment, or a non-stationary voiced speech segment. A different encoding mode is then used for each segment type. The pitch period is not encoded for silence segments and unvoiced speech segments, but is encoded for both stationary and non-stationary voiced speech segments.

In accordance with this multi-mode coding approach, when the current segment of the speech signal is a voiced speech segment and is preceded by a silence segment or unvoiced speech segment, then it is the first segment of a voiced speech region and there is no pitch period associated with the preceding segment that can be used for performing differential encoding. In this case, an embodiment encodes the pitch period associated with the current segment instantaneously using a fixed number of bits (i.e., it directly quantizes the pitch period rather than encoding a difference between the pitch periods associated with the current segment and the preceding segment). In further accordance with this embodiment, if the current segment is a voiced speech segment and is preceded by another voiced speech segment, then the difference between the pitch period associated with the current segment and the pitch period associated with the preceding segment is differentially encoded. Note that since the pitch period typically changes slowly during regions of voiced speech, the difference between the pitch periods of adjacent segments in these regions will typically be much smaller than the pitch period itself, and therefore can typically be encoded with a smaller number of bits than that used to instantaneously encode the pitch period.

Figure 6:
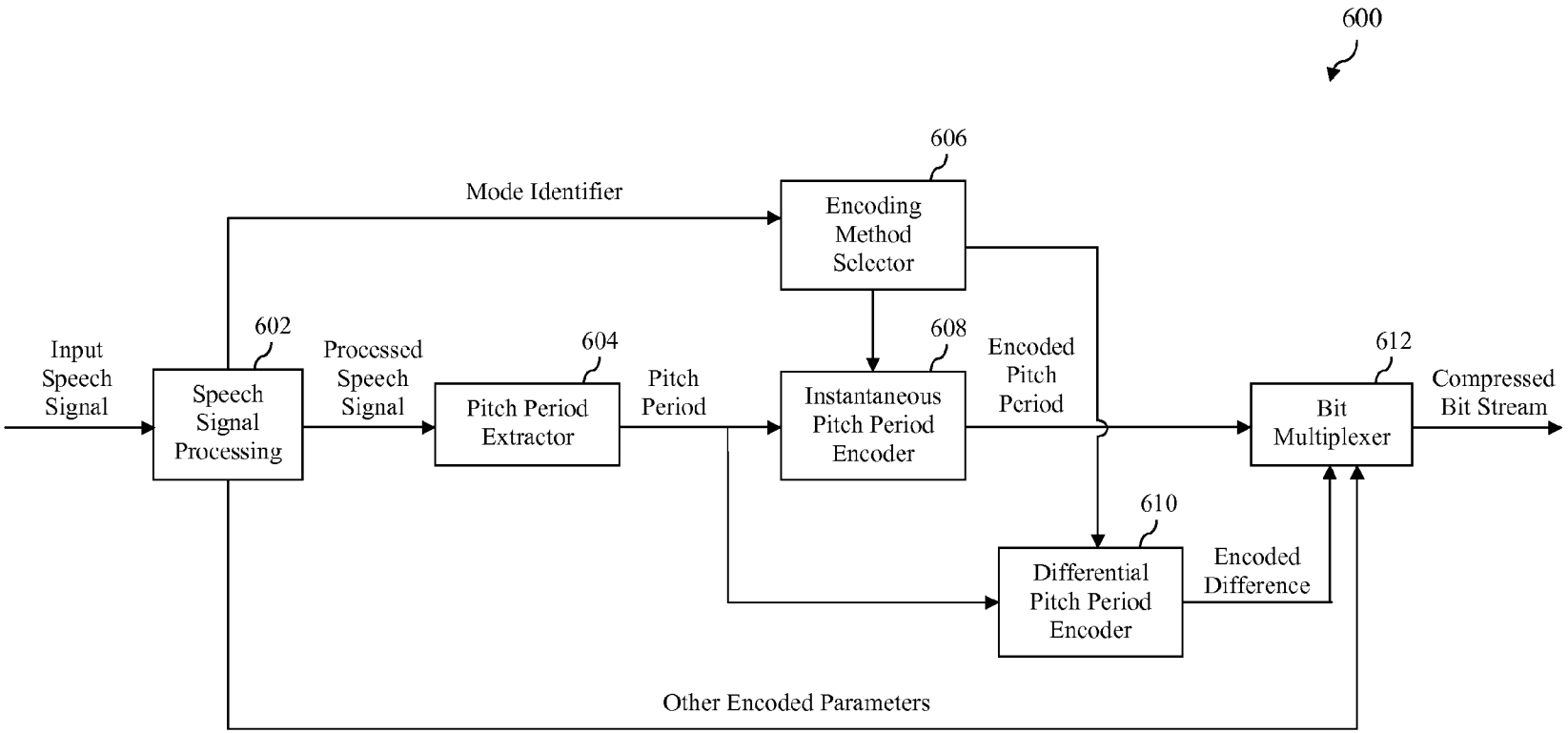
FIG. 6 is a block diagram of an alternative example encoder that implements a hybrid instantaneous/differential pitch period encoding scheme in accordance with an embodiment of the present invention.

FIG. 6 is a block diagram of an encoder 600 that implements the foregoing approach to hybrid instantaneous/differential pitch period encoding. Like encoder 300 described above in reference to FIG. 3, encoder 600 is configured to receive an input speech signal, to apply signal processing methods thereto to obtain a set of parameters that model the input speech signal on a segment-by-segment basis, and to apply data compression to the parameters obtained for each segment to generate a compressed bit stream for transmission or storage. Encoder 600 may also represent an implementation of encoder 102 as described above in reference to system 100 of FIG. 1 or encoder 202 as described above in reference to system 200 of FIG. 2, although these are only examples.

As shown in FIG. 6, encoder 600 includes a plurality of interconnected components, including a speech signal processing module 602, a pitch period extractor 604, an encoding method selector 606, an instantaneous pitch period encoder 608, a differential pitch period encoder 610 and a bit multiplexer 612. Each of these components may be implemented in software, in hardware, or as a combination of software and hardware. Speech signal processing module 602, pitch period extractor 604, instantaneous pitch period encoder 608, differential pitch period encoder 610 and bit multiplexer 612 operate in essentially the same manner as speech signal processing module 302, pitch period extractor 304, instantaneous pitch period encoder 308, differential pitch period encoder 310 and bit multiplexer 312, respectively, as described above in reference to encoder 300 of FIG. 3.

In contrast to encoding method selector 306 of encoder 300, however, encoding method selector 606 of encoder 600 determines whether the pitch period associated with each segment of the processed speech signal received from speech signal processing module 602 should be coded instantaneously or differentially based not upon the magnitude of the difference between pitch periods associated with adjacent segments, but instead upon whether or not each segment represents a first segment of a voiced speech region of the speech signal. As shown in FIG. 6, encoding method selector 606 may make this determination based on a mode identifier associated with each segment that is received from speech signal processing module 602.

For example, in one embodiment, the mode associated with each segment is represented by two bits, wherein "00" indicates that the segment is a silence segment, "01" indicates that the segment is an unvoiced speech segment, "10" indicates that the segment is a stationary voiced speech segment and "11" indicates that the segment is a non-stationary voiced speech segment. The mode identifier serves to identify the type of speech signal that a segment represents and how it is to be encoded by encoder 600. In accordance with such an embodiment, encoding method selector 606 will select instantaneous pitch period encoding if the mode identifier associated with a current segment is "10" or "11" (i.e., the current segment is a voiced speech segment) and the mode identifier associated with the preceding segment is "00" or "01" (i.e., the preceding segment is a silence or unvoiced speech segment) and will select differential pitch period encoding if the mode identifier associated with the current segment is "10" or "11" (i.e. the current segment is a voiced speech segment) and the mode identifier associate with the preceding segment is also "10" or "11" (i.e., the preceding segment is also a voiced speech segment). If the mode identifier associated with the current segment is "00" or "01," then the pitch period will not be encoded at all.

It is noted that, rather than relying on the mode identifier to determine if the current segment is the first segment of a voiced speech region of a speech signal, it is possible that encoding method selector 606 could instead rely upon one or more characteristics of the input speech signal that are determined by speech signal processing module 602 to determine whether or not a current segment comprises the first segment of a voiced speech signal. For example, encoding method selector 606 could analyze the signal characteristics associated with adjacent segments to determine whether or not a current segment is the first segment of a voiced speech region.

Figure 7:
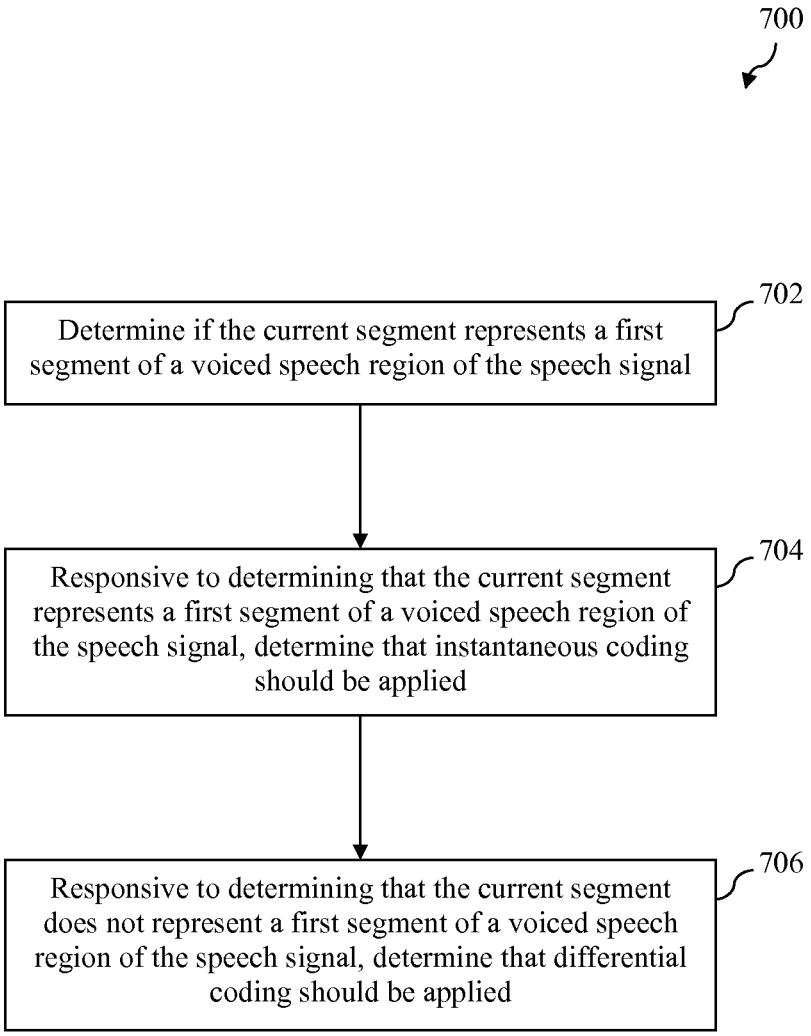
FIG. 7 depicts a flowchart of an alternate method for determining if instantaneous coding or differential coding should be applied to encode a pitch period associated with a segment of a speech signal in accordance with an embodiment of the present invention.

FIG. 7 depicts a flowchart 700 of a method for determining if instantaneous coding or differential coding should be applied to encode a pitch period associated with a segment of a speech signal in accordance with the approach described above in reference to encoder 600 of FIG. 6. However, the method of flowchart 700 may be implemented by other encoders as well.

As shown in FIG. 7, the method of flowchart 700 begins at step 702, in which it is determined whether the current segment of the speech signal represents a first segment of a voiced speech region of the speech signal. Step 702 may comprise, for example, determining if each of the current segment and a preceding segment of the speech signal represents voiced speech and then, responsive to determining that the current segment does represent voice speech and that the preceding segment does not represent voiced speech, determining that the current segment represents a first segment of a voiced speech region of the speech signal. As noted above, determining if each of the current segment and the preceding segment represents voiced speech may comprise analyzing an encoding mode identifier associated with each of the segments. The encoding mode identifier may be analyzed, for example, to determine if each of the segments represents one of silence, unvoiced speech, stationary voiced speech or non-stationary voiced speech. Alternatively, determining if each of the current segment and the preceding segment represents voiced speech may comprise analyzing one or more signal characteristics associated with each of the segments.

At step 704, responsive to determining that the current segment represents a first segment of a voice speech region of the speech signal, it is determined that instantaneous coding should be applied to encode the pitch period associated with the current segment.

At step 706, responsive to determining that the current segment does not represent a first segment of a voice speech region of the speech signal, it is determined that differential coding should be applied to encode the pitch period associated with the current segment. In an embodiment, this step comprises determining that differential coding should be applied to encode the pitch period associated with the current segment responsive to determining that the current segment represents a voiced speech segment that follows a preceding voiced speech segment.

Each of the steps of flowchart 700 may be performed, for example, by encoding method selector 606 of encoder 600 as described above in reference to FIG. 6, as that component receives the mode identifier (or, alternatively, signal characteristics) associated with each segment from speech signal processing module 602 and is thus capable of determining whether the current segments represents a first segment of a voiced speech region.

In an embodiment described above, entropy coding is used to differentially encode a pitch period associated with a segment of a speech signal. This approach will provide a lower average bit-rate than a conventional fixed-length coding scheme if the pitch period is a smooth-varying function of time; however, it requires a relatively large number of bits if the pitch period changes dramatically due to pitch period doubling, tripling, or halving that may be caused by less-than-ideal pitch extraction algorithms. As mentioned above, one method for dealing with this problem is to default to instantaneous coding if the number of bits needed to encode the difference is too large.

In another embodiment, to achieve the lowest possible average bit-rate, steps are taken to ensure that the pitch period contour as a function of time is as smooth as possible, thereby reducing the size of the pitch period difference between adjacent segments. Due to delay constraints, conventional speech codecs used for real-time communication typically do not include pitch extraction algorithms that are designed to "look ahead" to future segments. Instead, the pitch extraction algorithms used by such codecs have to estimate the pitch period of a current segment of a speech signal based only on the content of the current segment and previous segments. This makes it difficult to completely avoid pitch period doubling, tripling, or halving.

Certain embodiments of the present invention exploit the fact that in speech storage applications such as voice prompts, talking toys, and audio books, the encoding delay is not a constraint at all, and thus the speech encoder can look ahead many segments if necessary in order to eliminate most of the pitch period multiples (doubling, tripling, etc.) or sub-multiples (halving, etc.). One such embodiment implements this idea by utilizing a two-pass approach for pitch extraction.

Figure 8:
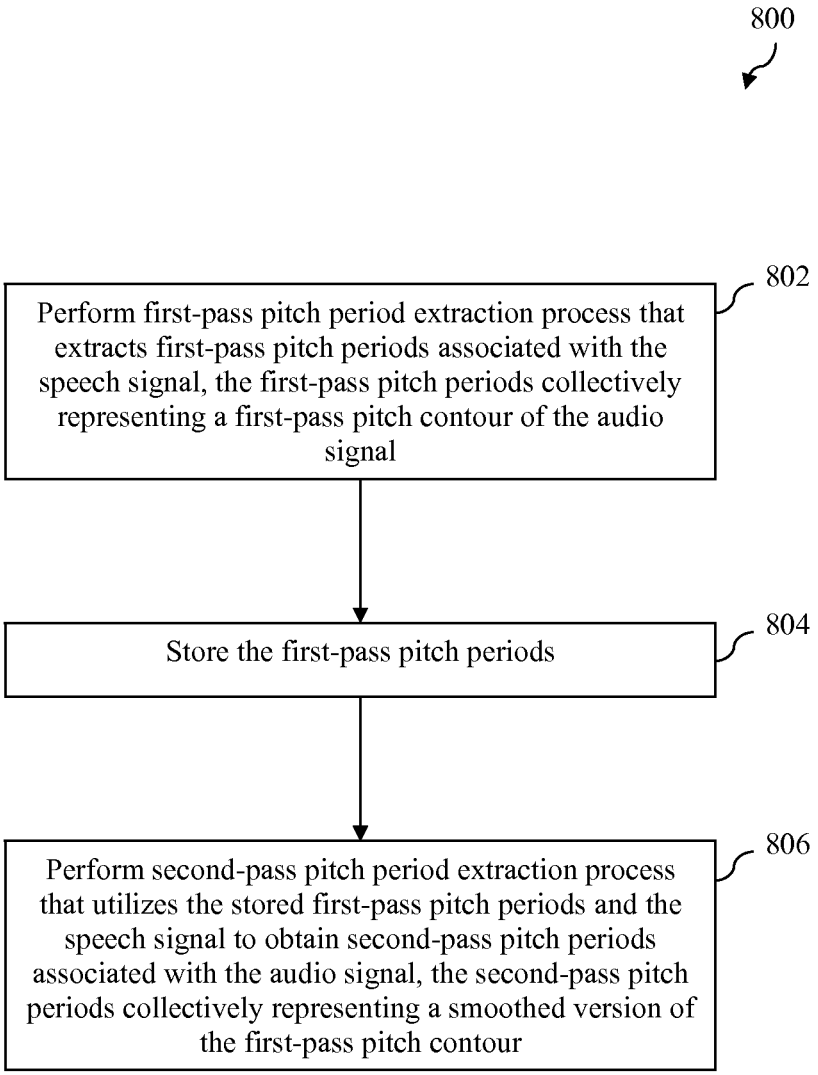
FIG. 8 depicts a flowchart of a two-pass pitch period extraction method in accordance with an embodiment of the present invention.

FIG. 8 depicts a flowchart 800 of such a two-pass pitch period extraction method. As shown in FIG. 8, the method begins at step 802 in which a first-pass pitch period extraction process is performed that extracts first-pass pitch periods associated with a speech signal to be encoded. The first-pass pitch period extraction is performed on the entire speech signal, which may be provided from a file or via some other means. The first-pass pitch period extraction process may comprise a conventional low-delay pitch period extraction process. Consequently, the resulting first-pass pitch periods may have occasional pitch period multiples or sub-multiples. Taken together, the first-pass pitch periods collectively represent a first-pass pitch contour of the speech signal.

At step 804, the first-pass pitch periods are stored. Such first-pass pitch periods may be stored, for example, in a file accessible to the two-pass pitch period extractor.

At step 806, a second-pass pitch period extraction process is performed that utilizes the stored first-pass pitch periods and the speech signal to obtain second-pass pitch periods associated with the speech signal. In particular, the second-pass pitch extraction process analyzes both the speech signal and the previously-saved first-pass pitch periods. Since the second-pass pitch period extraction process can "look ahead" to the first-pass pitch periods associated with all future segments, it is capable of rendering intelligent decisions to eliminate the pitch period multiples and sub-multiples. Furthermore, to place a limit on the maximum number of bits consumed in encoding the pitch period of any given segment, the second-pass pitch extraction process can place a constraint on the maximum pitch period difference allowed between adjacent segments. In accordance with one example embodiment in which instantaneous coding of the pitch period is achieved using 7-bit uniform quantization and differential coding of the pitch period is achieved using the Huffman coding scheme shown in Table 1, a suitable maximum pitch period difference allowed may be 13 samples.

The performance of the second-pass pitch period extraction process of step 806 results in the generation of a set of second-pass pitch periods that collectively represent a smoothed version of the first-pass pitch contour. Such a smoothed pitch contour is particularly suitable for differential entropy coding.

D. Example Decoder in Accordance with Embodiments of the Present Invention

Figure 9:
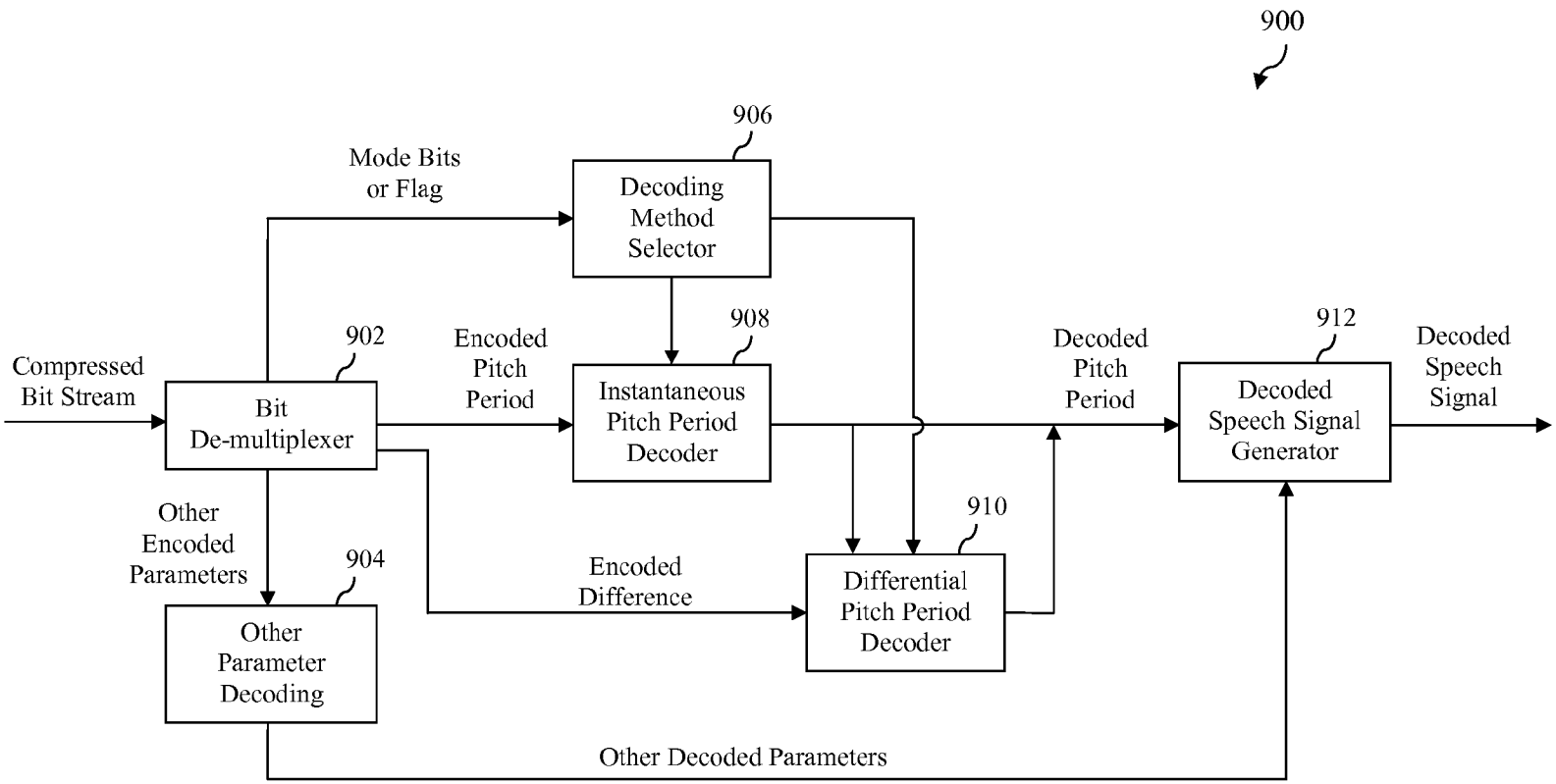
FIG. 9 is a block diagram of an example decoder that implements a hybrid instantaneous/differential pitch period decoding scheme in accordance with an embodiment of the present invention.

FIG. 9 is a block diagram of an example decoder 900 that implements a hybrid instantaneous/differential pitch period decoding scheme in accordance with an embodiment of the present invention. Generally speaking, decoder 900 is configured to receive a compressed bit stream, to extract an encoded representation of each segment of a speech signal therefrom, the encoded representation of each segment including a plurality of encoded parameters, to decode each of the encoded parameters associated with a segment, and to use the decoded parameters associated with each segment to generate a decoded speech signal. Decoder 900 may represent an implementation of decoder 106 as described above in reference to system 100 of FIG. 1 or decoder 206 as described above in reference to system 200 of FIG. 2, although these are only examples.

As shown in FIG. 9, decoder 900 includes a plurality of interconnected components, including a bit de-multiplexer 902, an other parameter decoding module 904, a decoding method selector 906, an instantaneous pitch period decoder 908, a differential pitch period decoder 910, and a decoded speech signal generator 912. Each of these components may be implemented in software, through the execution of instructions by one or more general purpose or special-purpose processors, in hardware, using analog and/or digital circuits, or as a combination of software and hardware. Each of these components will now be described.

Bit de-multiplexer 902 operates to receive a compressed bit stream that contains encoded representations of each segment of an encoded speech signal and to extract a set of encoded parameters for each segment. In certain embodiments, the encoded parameters extracted by bit de-multiplexer for a segment will always include either an instantaneously-encoded or differentially-encoded pitch period, which bit de-multiplexer 902 respectively provides to either instantaneous pitch period decoder 908 or differential pitch period decoder 910 for decoding.

In a multi-mode coding embodiment such as that described below in Section E, the set of encoded parameters for a particular segment may or may not include an encoded pitch period. For example, in one embodiment, if the segment is a silence or unvoiced speech segment, then the set of encoded parameters will not include an encoded pitch period but if the segment is a stationary or non-stationary voiced speech segment, then the set of encoded parameters will include either an instantaneously-encoded or differentially-encoded pitch period. In accordance with such an embodiment, bit de-multiplexer 902 will first determine if the set of encoded parameters for a segment includes either an instantaneously-encoded or differentially-encoded pitch period. If the set of encoded parameters for the segment does include either an instantaneously-encoded or differentially-encoded pitch period, then bit de-multiplexer 902 will either forward the instantaneously-encoded pitch period to instantaneous pitch period decoder 908 for decoding or will forward the differentially-encoded pitch period to differential pitch period decoder 910 for decoding, as appropriate.

For segments that require pitch period decoding, bit de-multiplexer 902 will also extract one or more bits included within the encoded representation of each segment and provide those one or more bits to decoding method selector 906 to facilitate a determination of what type of pitch period decoding should be applied. In one embodiment, a single bit may be used as a binary flag to indicate whether instantaneous pitch period decoding should be applied or differential pitch period decoding should be applied. In an embodiment such as that described in Section E that supports multi-mode coding, mode bits that serve to classify a segment as silence, unvoiced speech, or voiced speech (both stationary and non-stationary) may be used to determine whether the current segment is the first segment in a voiced speech region and thus, that instantaneous rather than differential decoding should be applied. These mode bits may also be utilized by other parameter decoding 904 to selectively apply different decoding algorithms to each segment based on the segment type.

Decoding method selector 906 is configured to receive one or more bits (e.g., a binary flag or mode bits as discussed above) associated with each segment that includes an encoded pitch period from bit de-multiplexer 902 and to use those one or more bits to decide, on a segment-by-segment basis, whether an instantaneous pitch period decoding method or a differential pitch period decoding method should be applied to decode the encoded pitch period. If decoding method selector 906 selects the instantaneous pitch period decoding method, then decoding method selector 906 will invoke or otherwise activate instantaneous pitch period decoder 908 to apply an instantaneous decoding method to decode the pitch period associated with a current segment while causing differential pitch period decoder 910 to remain inactive for the current segment. However, if decoding method selector 906 selects the differential pitch period decoding method, then decoding method selector 906 will invoke or otherwise activate differential pitch period decoder 910 to apply a differential decoding method to decode the pitch period associated with the current segment while causing instantaneous pitch period decoder 908 to remain inactive for the current segment.

In accordance with certain embodiments, instantaneous pitch period decoder 908 decodes the encoded pitch period associated with the current segment by de-quantizing a quantized representation of the pitch period itself while differential pitch period decoder 910 decodes an encoded representation of a difference between the pitch period associated with the current segment and a pitch period associated with a segment that immediately precedes the current segment. Differential pitch period decoder 910 then adds the difference to the pitch period associated with the preceding segment to obtain the pitch period associated with the current segment. As noted in the preceding section, the difference may be encoded using a fixed bit-rate quantization scheme or a variable bit-rate entropy coding scheme. Thus, depending upon the decision made by decoding method selector 906 for the current segment, a decoded pitch period will be produced by either instantaneous pitch period decoder 908 or by differential pitch period decoder 910. In either case, the decoded pitch period is provided to decoded speech signal generator 912.

Other parameter decoding module 904 is intended to represent the logic of decoder 900 that operates to decode all the encoded parameters associated with each speech signal segment with the exception of the encoded pitch period. As will be appreciated by persons skilled in the relevant art(s), the structure, function and operation of other parameter decoding module 904 will vary depending upon the codec design. In an example implementation in which decoder 900 comprises a modified version of a BV16 or BV32 decoder, other parameter decoding module 904 may operate to decode encoded parameters that include encoded representations of LSP parameters, three pitch taps, an excitation gain and excitation vectors associated with each 5 ms frame of the speech signal. The decoded parameters generated by other parameter decoding module 904 are provided to decoded speech signal generator 912.

For each segment, speech signal generator 912 receives a decoded pitch period from instantaneous pitch period decoder 908 or differential pitch period decoder 910 and a set of other decoded parameters from other parameter decoding module 904. Speech signal generator 912 uses the decoded parameters for each segment to generate a corresponding segment of a decoded speech signal. As noted above, in certain multi-mode coding implementation, a decoded pitch period will not be generated for certain segments. In such embodiments, decoded speech signal generator will generate corresponding segments of the decoded speech signal in a manner that does not require using a decoded pitch period.

Figure 10:
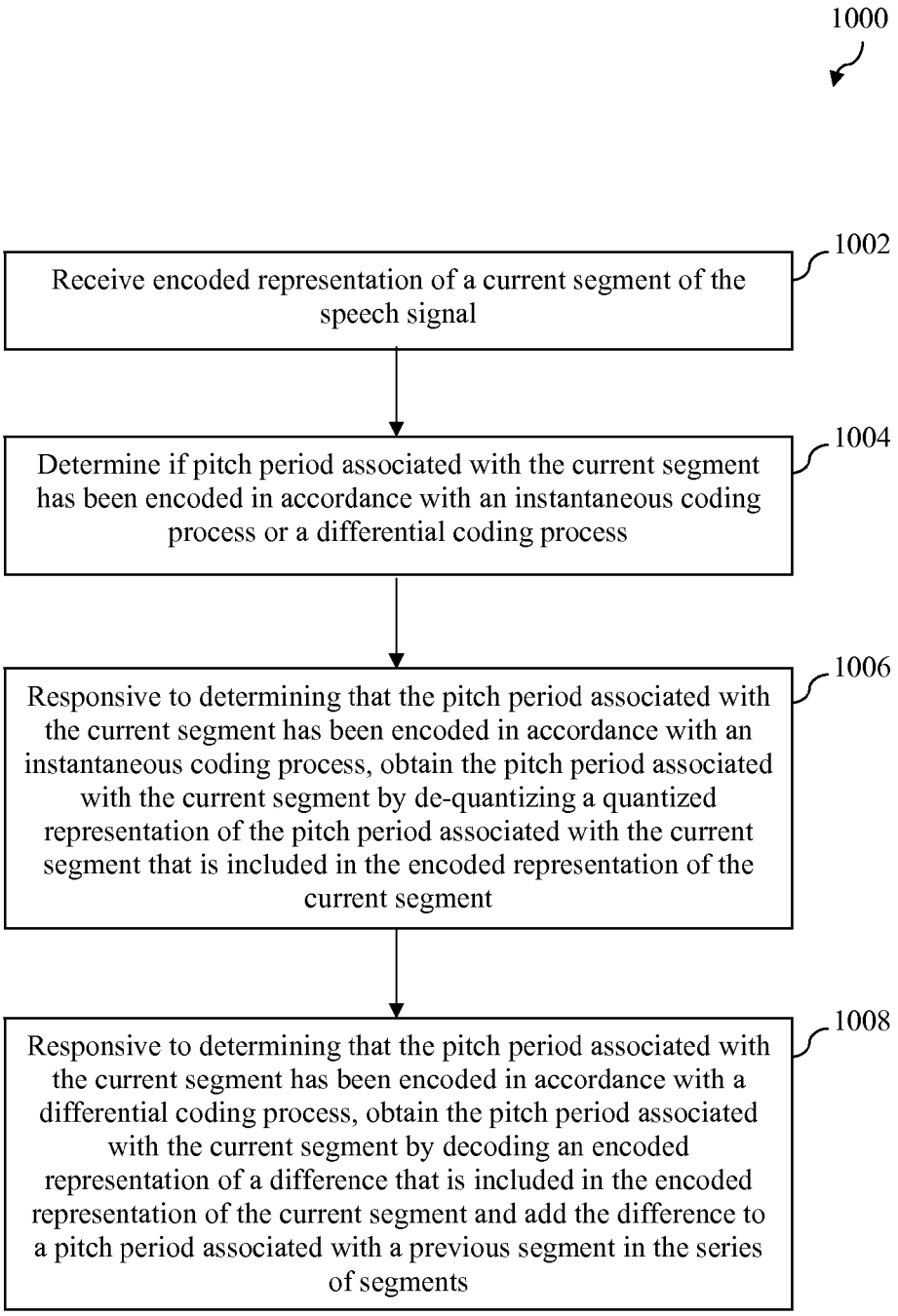
FIG. 10 depicts a flowchart of one method for performing hybrid instantaneous/differential decoding of a pitch period associated with a segment of a speech signal in accordance with an embodiment of the present invention.

FIG. 10 depicts a flowchart 1000 of one method for performing hybrid instantaneous/differential decoding of a pitch period associated with a segment of a speech signal in accordance with an embodiment of the present invention. The method of flowchart 1000 may be implemented, for example, by decoder 900 of FIG. 9, although the method may be implemented in many other decoders as well.

As shown in FIG. 10, the method of flowchart 1000 begins at step 1002 in which an encoded representation of a current segment of the speech signal is received. This step may be performed, for example, by bit de-multiplexer 902 of decoder 900 as described above in reference to FIG. 9.

At step 1004, a determination is made as to whether a pitch period associated with the current segment has been encoded in accordance with an instantaneous coding process or a differential coding process. This step may be performed, for example, by decoding method selector 906 of decoder 900 as described above in reference to FIG. 9. This determination may be made, for example, by analyzing one or more bits (e.g., a flag bit or mode bits) provided by bit de-multiplexer 902 to determine which encoding method was used.

At step 1006, responsive to a determination that the pitch period associated with the current segment was encoded in accordance with an instantaneous coding process, the pitch period associated with the current segment is obtained by de-quantizing a quantized representation of the pitch period associated with the current segment that is included in the encoded representation of the segment. This step may be performed, for example, by instantaneous pitch period decoder 908 of decoder 900 as described above in reference to FIG. 9.

At step 1008, responsive to a determination that the pitch period associated with the current segment was encoded in accordance with a differential coding process, the pitch period associated with the current segment is obtained by decoding an encoded representation of a difference that is included in the encoded representation of the current segment and by adding the difference to a pitch period associated with a previous segment in the series of segments. This step may be performed, for example, by differential pitch period decoder 910 of decoder 900 as described above in reference to FIG. 9.

Figure 11:
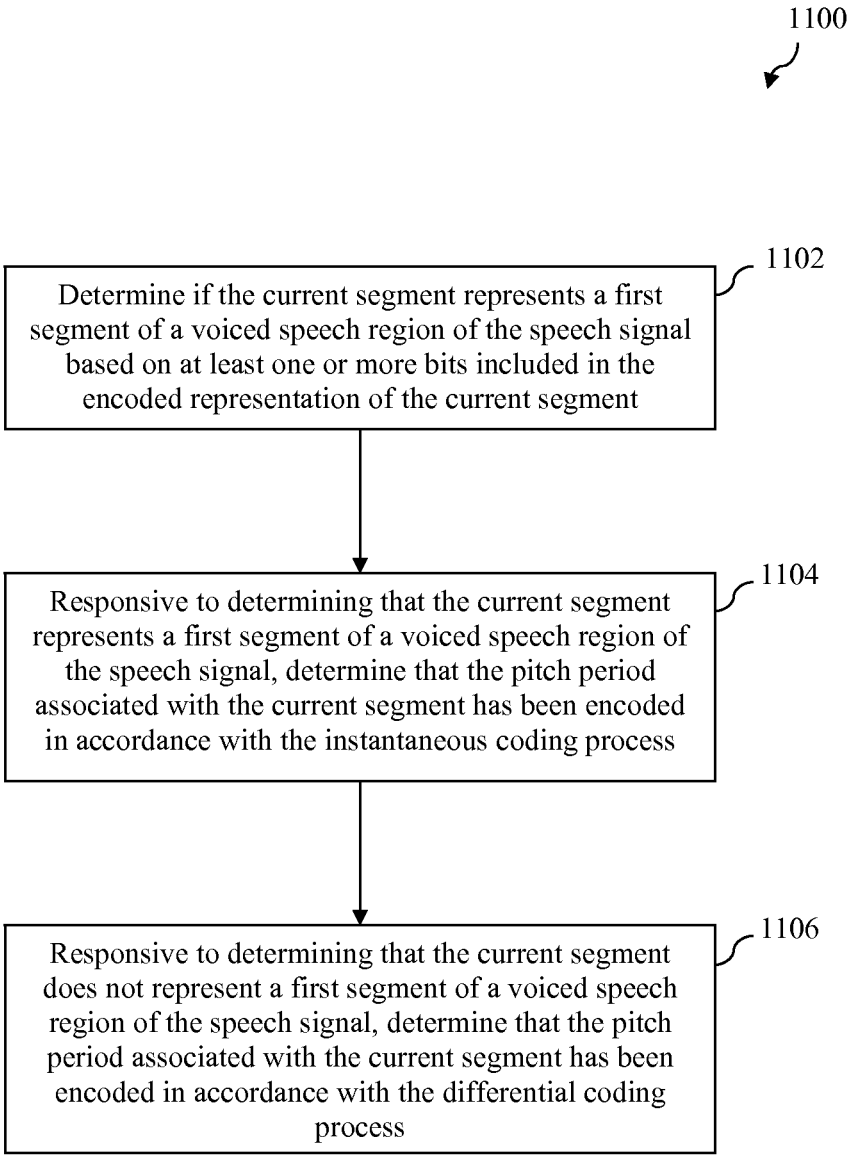
FIG. 11 depicts a flowchart of a method for determining whether a pitch period associated with a segment of a speech signal has been encoded in accordance with an instantaneous coding process or a differential coding process in accordance with an embodiment of the present invention.

As discussed in the preceding section, certain encoders in accordance with embodiments of the present invention use instantaneous coding to encode the pitch period only when a segment is the first segment of a voiced speech region. Thus, in certain decoder embodiments, the determination of whether a pitch period associated with the current segment has been encoded in accordance with an instantaneous coding process or a differential coding process is based on whether the segment is the first segment of a voiced speech region of the speech signal. FIG. 11 depicts a flowchart 1100 of a method for making this determination in accordance with such an embodiment. The method of flowchart 1100 may be performed, for example, by decoding method selector 906 of decoder 900, although this is only an example.

As shown in FIG. 11, the method of flowchart 1100 begins at step 1102 in which a determination is made as to whether the current segment represents a first segment of a voiced speech region of the audio signal based on at least one or more bits included in the encoded representation of the current segment.

At step 1104, responsive to determining that the current segment represents a first segment of a voiced speech region of the audio signal, it is determined that the pitch period associated with the current segment has been encoded in accordance with the instantaneous coding process.

At step 1106, responsive to determining that the current segment does not represent a first segment of a voiced speech region of the audio signal, it is determined that the pitch period associated with the current segment has been encoded in accordance with the differential coding process. In accordance with one multi-mode coding embodiment, this step also assumes that the current segment is either a stationary or non-stationary voiced speech segment. In further accordance with such an embodiment, if the current segment is a silence or unvoiced speech segment, no pitch period decoding will be performed.

Figure 12:
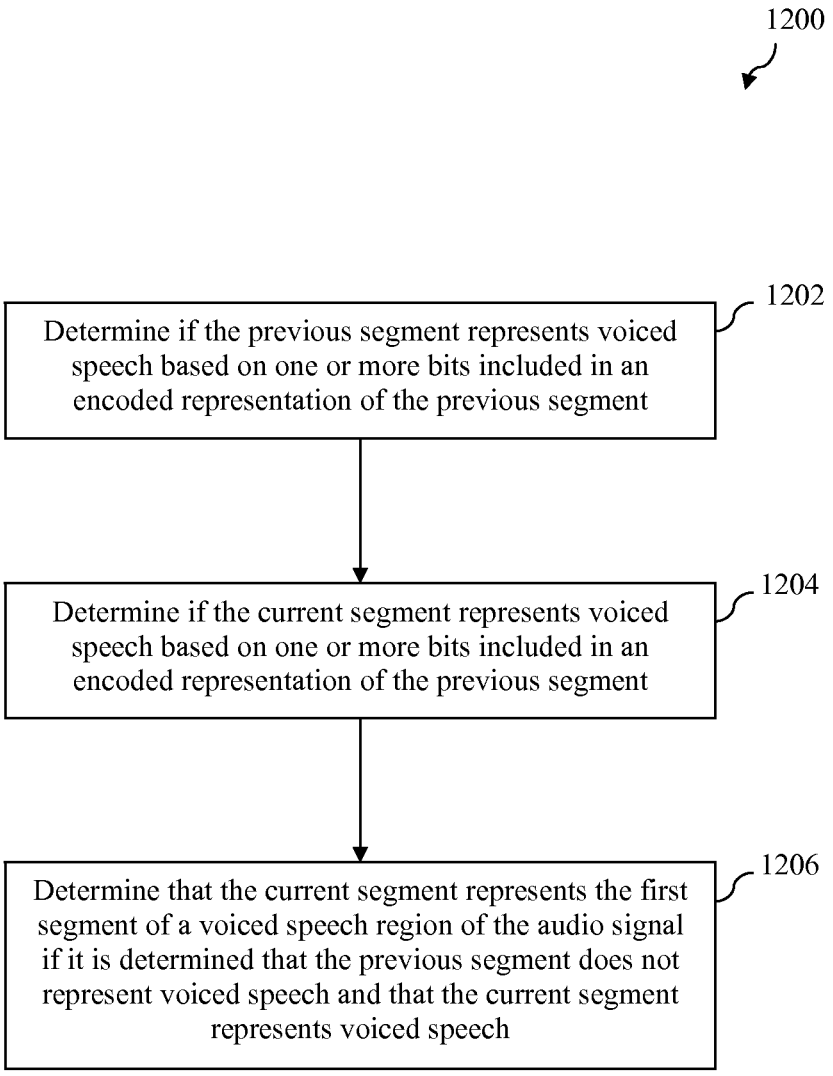
FIG. 12 depicts a flowchart of one method for determining whether a current segment of a speech signal represents a first segment of a voiced speech region based on at least one or more bits included in an encoded representation of the current segment in accordance with an embodiment of the present invention.

FIG. 12 depicts a flowchart 1200 of one method for determining whether a current segment of a speech signal represents a first segment of a voiced speech region based on at least one or more bits included in an encoded representation of the current segment in accordance with an embodiment of the present invention.

As shown in FIG. 12, the method of flowchart 1200 begins at step 1202, in which it is determined if the previous segment represents voiced speech based on one or more bits included in an encoded representation of the previous segment. These bits may comprise, for example, mode bits as described in the preceding section and in Section E, below.

At step 1204, it is determined if the current segment represents voiced speech based on one or more bits included in an encoded representation of the previous segment. These bits may also comprise, for example, mode bits as described in the preceding section and in Section E, below.

At step 1206, it is determined that the current segment represents the first segment of a voiced speech region of the audio signal if it is determined that the previous segment does not represent voiced speech and that the current segment represents voiced speech.

E. Example Multi-Mode, Variable-Bit-Rate Coding Implementation

An example multi-mode, variable-bit-rate codec will now be described that uses a hybrid instantaneous/differential coding scheme for coding a pitch period in accordance with an embodiment of the present invention.

The objectives of the codec described in this section are the same as those of conventional speech codecs. However, its specific design characteristics make it unique compared to the conventional codecs. In targeted speech or audio storage applications, the encoded bit-stream of the input speech or audio signal is pre-stored in a system device, and only a decoding part is operated in a real-time manner. Channel errors and encoding delay are not critical issues. However, an average bit-rate and the decoding complexity of the codec should be as small as possible due to limitations of memory space and computational complexity.

Even with relaxed constraints on encoding complexity, encoding delay, and channel-error robustness, it is still a challenge to generate high-quality speech at a bit-rate of 4 to 5 kbit/s, which is the target bit-rate of the codec described in this section. The core encoding described in this section is a variant of the BV16 codec as described by J.-H. Chen and J. Thyssen in "The BroadVoice Speech Coding Algorithm," *Proceedings of* 2007 *IEEE International Conference on Acoustics, Speech, and Signal Processing*, pp. IV-537-IV-540, April 2007, the subject matter of which has been incorporated by reference herein. However, the speech codec described in this section incorporates several novel techniques to exploit the unique opportunity to have increased encoding complexity, increased encoding delay, and reduced robustness to channel errors.

In accordance with one implementation, the multiple-mode, variable-bit-rate speech codec described in this section selects a coding mode for each frame of an input speech signal, wherein the mode is determined in a closed-loop manner by trying out all possible coding modes for that frame and then selecting a winning coding mode using a sophisticated mode-decision logic based on a perceptually motivated psychoacoustic hearing model. This approach will normally result in very high encoding complexity and will make the resulting encoder impractical. However, by recognizing that the encoding complexity is not a concern for audio books, talking toys, and voice prompts applications, an embodiment of the multi-mode, variable-bit-rate speech codec uses such sophisticated high-complexity mode-decision logic to try to achieve the best possible speech quality.

1. Multi-Mode Coding

A multi-mode coding technique has been introduced to reduce average bit-rate while maintaining high perceptual quality. Although this technique utilizes flag bits to inform which encoding mode is used for the specified frame, it can save redundant bits that do not play a major role in generating high quality speech. For example, virtually no bits are needed for silence frames, and pitch related parameters can be disregarded for synthesizing unvoiced frames. The codec described in this section has four different encoding modes: silence, unvoiced, stationary voiced, and non-stationary voiced (or onset). The brief encoding guideline of each mode is summarized in Table 2.

TABLE 2

Multi-Mode Encoding Scheme

| Mode | Signal characteristics in general | Description |
|---|---|---|
| 0 | Silence | No bits are allocated to any parameters |
| 1 | Unvoiced | Allocates a small number of bits to spectral parameters<br>No bits are allocated to periodic excitation<br>Only non-periodic excitation vectors are used |
| 2 | Stationary voiced | Allocates a relatively large number of bits to spectral parameters<br>Use both periodic and non-periodic excitation vectors |
| 3 | Non-stationary voiced | Allocates a relatively large number of bits to spectral parameters<br>Uses both periodic and non-periodic excitation vectors |

TABLE 2-continued

Multi-Mode Encoding Scheme

| Mode | Signal characteristics in general | Description |
|---|---|---|
| | | Decreases the vector dimension of random excitation codeword to improve quality in onset regions |

To efficiently design a multi-mode encoding scheme, it is very important to select an appropriate encoding mode for each frame because the average bit-rate and perceptual quality are varied depending on the ratio of choosing each encoding mode. A silence region can be easily detected by comparing the energy level of the encoded frame with that of the reference background noise frames. However, many features representing spectral and/or temporal characteristics are needed to accurately classify active voice frames into one of voiced, unvoiced, or onset modes. Conventional multi-mode coding approaches adopt a sequential approach such that an encoding mode of the frame is first determined, and then input signals are encoded using the determined encoding method. Since the complexity of the decision logic is relatively low compared to full encoding methods, this approach has been successfully deployed into real-time communication systems. However, the quality drops significantly if the decision logic fails to find a correct encoding mode.

Figure 13:
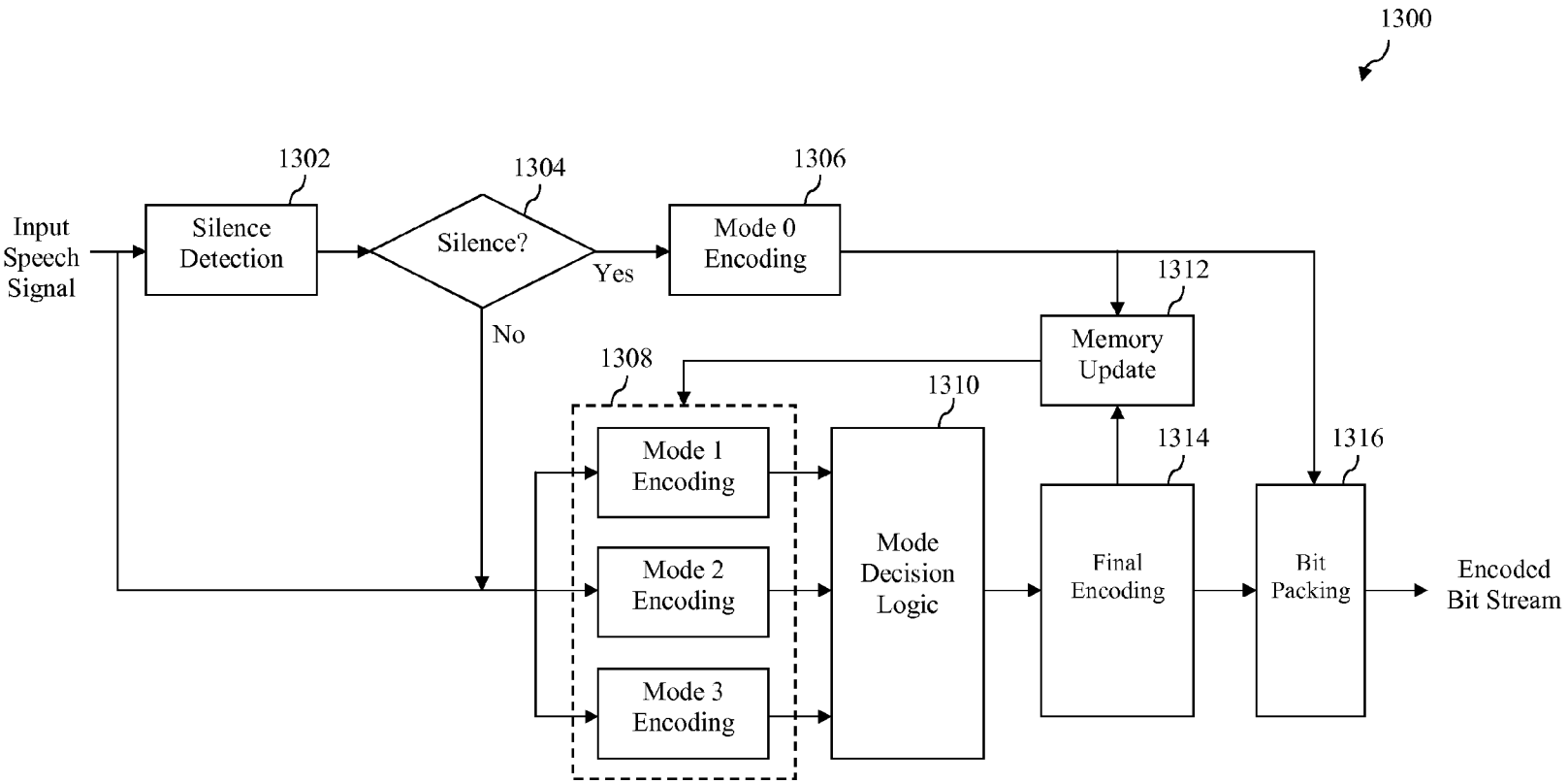
FIG. 13 is a block diagram of a multi-mode encoder in accordance with a particular embodiment of the present invention.
Figure 14:
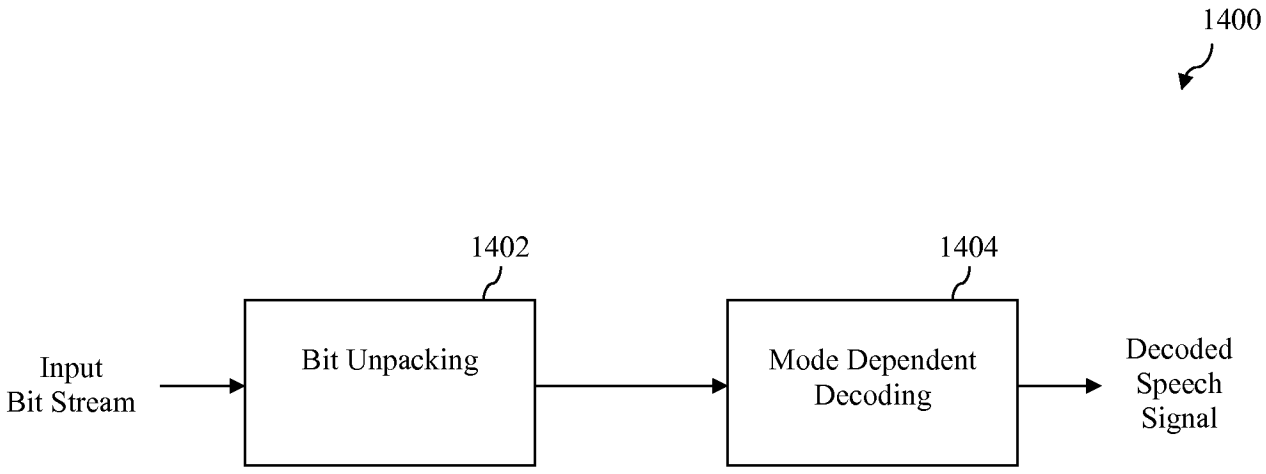
FIG. 14 is a block diagram of a multi-mode decoder in accordance with a particular embodiment of the present invention.

Since the codec described in this section does not have stringent requirements for encoding complexity, a more robust algorithm can be used. In particular, the codec described herein adopts a closed-loop full search method such that the final encoding mode is determined by comparing similarities of the output signals of different encoding modes to the reference input signal. FIG. 13 is a block diagram of a multi-mode encoder 1300 in accordance with this approach while FIG. 14 is a block diagram of a multi-mode decoder 1400 in accordance with this approach.

As shown in FIG. 13, multi-mode encoder 1300 includes a silence detection module 1302, silence decision logic 1304, a mode 0 encoding module 1306, a multi-mode encoding module 1308, mode decision logic 1310, a memory update module 1312, a final encoding module 1314 and a bit packing module 1316.

Silence detection module 1302 analyzes signal characteristics associated with a current frame of the input speech signal that can be used to estimate if the current frame represents silence. Based on the analysis performed by silence detection module 1302, silence decision logic 1304 determines whether or not the current frame represents silence. If silence decision logic 1304 determines that the current frame represents silence, then the frame is encoded by mode 0 encoding module 1306 and encoded parameters associated with the segment are output by mode 0 encoding module 1306 to bit packing module 1316.

If silence decision logic 1304 determines that the current frame does not represent silence, then the current frame is deemed an active voice frame. For active voice frames, multi-mode encoding module 1308 first generates decoded signals using all encoding modes: mode 1, 2, and 3. Mode decision logic 1310 calculates similarities between the reference input speech signal and all decoded signals by subjectively-motivated measures. Mode decision logic 1310 determines the final encoding mode by considering both the average bit-rate and perceptual quality. Final encoding module 1314 encodes the current frame in accordance with the final encoding mode.

Memory update module 1312 updates a look-back memory of the encoding parameter by the output of the selected encoding mode. Bit packing module 1316 operates to combine the encoded parameters associated with a frame for storage as part of an encoded bit-stream.

As shown in FIG. 14, multi-mode decoder 1400 includes a bit unpacking module 1402 and a mode-dependent decoding module 1404. Bit unpacking module 1402 receives the encoded bit stream as input and extracts a set of encoded parameters associated with a current frame therefrom, including one or more bits that indicate which mode was used to encode the parameters. Mode-dependent decoding module 1404 performs one of a plurality of different decoding processes to decode the encoded parameters depending on the one or more mode bits extracted by bit unpacking module 1402. Mode-dependent decoding module 1404 then uses the decoded parameters to generate a frame of a decoded speech signal.

2. Core Codec Structure and Bit Allocations

In an embodiment, the multi-mode, variable-bit rate codec utilizes four different encoding modes. Since no bits are needed for mode 0 (silence) except two bits for mode information, there are three encoding methods (mode 1, 2, 3) to be designed carefully. The baseline codec structure of one embodiment of the multi-mode, variable-bit rate codec is taken from the BV16 codec that has been adopted as a standard speech codec for voice communications through digital cable networks. See "BV16 Speech Codec Specification for Voice over IP Applications in Cable Telephony," American National Standard, ANSI/SCTE 24-21 2006, the entirety of which is incorporated by reference herein.

Mode 1 is designed for handling unvoiced frames, thus it does not need any pitch-related parameters for the long-term prediction module. Modes 2 and 3 are mainly used for voiced or transition frames, thus encoding parameters are almost equivalent to the BV16. Differences between the BV16 and a multi-mode, variable-bit-rate codec in accordance with an embodiment may include frame/sub-frame lengths, the number of coefficients for short-term linear prediction, inter-frame predictor order for LSP quantization, vector dimension of the excitation codebooks, and allocated bits to transmitted codec parameters.

Although the multi-mode codec described above can reduce the average bit rate, to further improve bit-rate reduction, the codec utilizes a hybrid instantaneous/differential pitch period coding scheme in accordance with the present invention.

Conventional speech codecs often use 7-bit instantaneous uniform quantization (for 8 kHz sampling rate) to quantize the pitch period into one of 128 consecutive integers (for example, from 20 to 147 samples). If the pitch period is determined and encoded once every 5 ms, then the encoding of the pitch period alone takes 7*1000/5=1400 bits/sec. This is a rather inefficient use of bits if the total encoding bit-rate of the speech codec is only on the order of 4 to 5 kb/s. Since an embodiment of a multi-mode, variable-bit-rate codec described herein uses pitch-related information in voiced regions (modes 2 and 3) where the pitch period typically changes slowly with time, the average encoding bit-rate for the pitch period can be greatly reduced with a hybrid instantaneous/differential coding scheme.

Specifically, when the current frame is preceded by a frame of mode 0 (silence) or mode 1 (unvoiced), then it is the first frame of a voiced region, and there is no immediately preceding pitch period to do differential coding from, and thus such a pitch period is encoded instantaneously using 7 bits (i.e. directly quantized without deriving a difference from the previous pitch period). On the other hand, if the current mode-2 or mode-3 frame is preceded by another mode-2 or mode-3 frame, then the difference between the pitch period of the current frame and the pitch period of the preceding frame is encoded. That is, the pitch period of the current frame is "differentially coded". Note that since the pitch period typically changes slowly, the difference between the pitch periods of adjacent frames is typically much smaller than the pitch period itself, and therefore the difference can be encoded with a smaller number of bits than 7 bits. Thus, an average bit-rate lower than 7 bits/frame can be achieved with such a hybrid instantaneous/differential coding scheme.

It should be noted that in such a hybrid coding scheme, there is no need to transmit an additional bit each frame to distinguish between the instantaneous 7-bit encoding and the differential coding, because it is implied by the relative position of the frame within the current voiced region. If the current mode-2 or mode-3 frame is preceded by a mode-0 or mode 1 frame (i.e. it is the first frame in a streak of mode-2 or mode-3 frames), 7-bit instantaneous coding of the pitch period is used; otherwise, differential coding is used.

A possible embodiment of the multi-mode, variable-bit-rate codec is to use a conventional fixed bit-rate quantizer to quantize the pitch period difference in the differential coding mode. In this case, a quantizer of at least 3 or 4 bits may be needed. However, a preferred embodiment of the multi-mode, variable-bit-rate codec uses variable-bit-rate entropy coding to achieve an even lower average bit-rate for the differential coding mode.

The entropy-coding approach will give a lower average bit-rate than a conventional fixed-length coding scheme if the pitch period is a smooth-varying function of time; however, it requires a huge number of bits if the pitch period changes dramatically due to pitch period doubling, tripling, or halving that may be caused by less-than-ideal pitch extraction algorithms. Therefore, to achieve the lowest possible average bit-rate, it is imperative to make sure the pitch period contour as a function of time is as smooth as possible. Thus, one embodiment of the multi-mode, variable-bit-rate codec utilizes a two-pass pitch extraction algorithm as described above to ensure that the pitch period contour as a function of time is as smooth as possible.

In an alternative embodiment of the multi-mode, variable-bit-rate codec, more flexibility is given to the pitch period quantizer and the quantized pitch period is not constrained to have a smooth contour as described above. In certain codec configurations, relaxing the smooth pitch contour constraint may help to maximize the performance of the pitch predictor. In this case, the pitch period can be encoded by a "safety-net" hybrid pitch encoding scheme described as follows. The safety-net hybrid coding scheme determines a mode from two candidate modes consisting of normal instantaneous uniform quantization and the variable entropy coding. Though it requires a single bit to indicate the encoding mode for the pitch period, its average pitch encoding bit-rate can be lower than using any of the two modes constantly by itself To further reduce the bit-rate, pitch candidates of a second sub-frame can be limited to the neighborhood of the selected pitch lag of a first sub-frame that immediately precedes the second sub-frame.

$$p_2=p_1^*+m,\ m=-\Delta, \ldots, \Delta+1,$$

where $p_2$ denotes pitch candidates of the second sub-frame, and $p_1^*$ is the selected pitch candidate from the first sub-frame. The value of $\Delta$ determines the quality and bit-rate. Based on experiments, $\Delta$ is set to 3. Thus, only 3 bits are assigned to quantize the pitch period of the second frame. It should be noted that the entropy coding can still be used for this scheme, too.

F. Example Computer System Implementation

It will be apparent to persons skilled in the relevant art(s) that various elements and features of the present invention, as described herein, may be implemented in hardware using analog and/or digital circuits, in software, through the execution of instructions by one or more general purpose or special-purpose processors, or as a combination of hardware and software.

Figure 15:
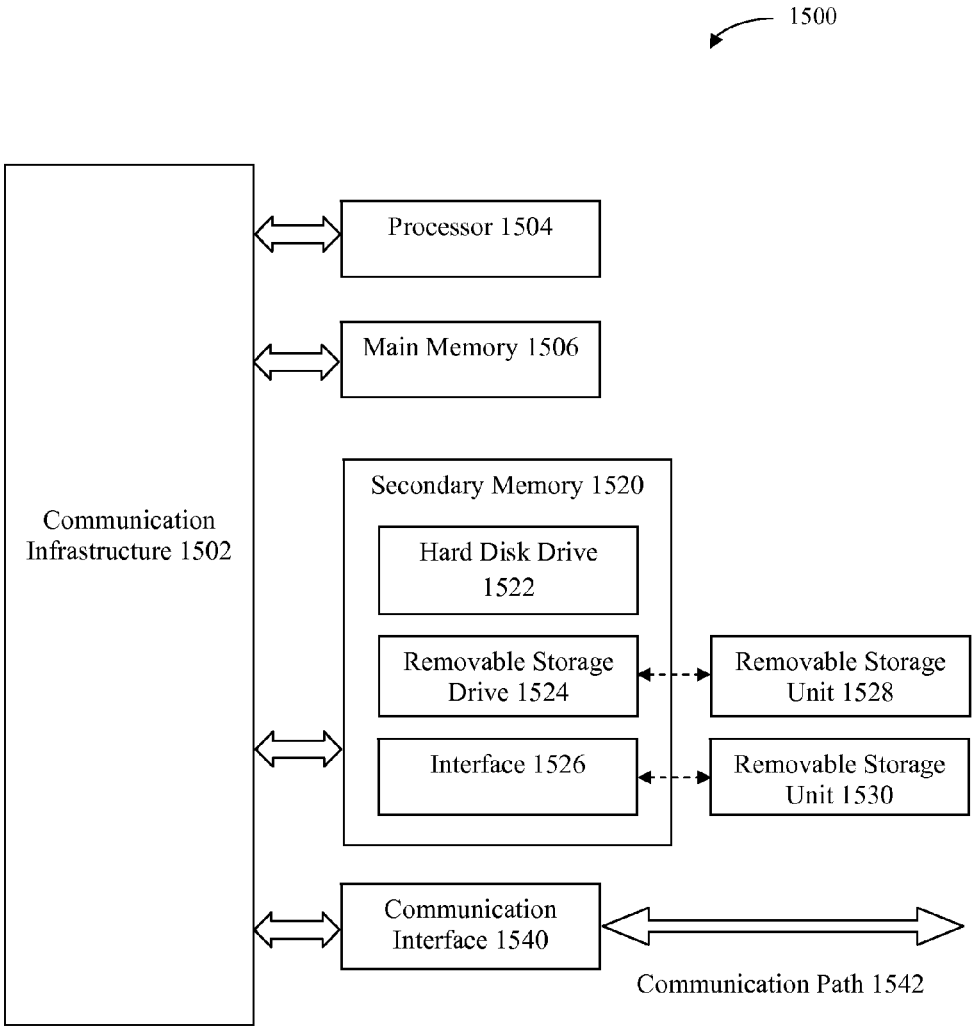
FIG. 15 is a block diagram of an example computer system that may be used to implement aspects of the present invention.

The following description of a general purpose computer system is provided for the sake of completeness. Embodiments of the present invention can be implemented in hardware, or as a combination of software and hardware. Consequently, embodiments of the invention may be implemented in the environment of a computer system or other processing system. An example of such a computer system 1500 is shown in FIG. 15. All of the logic blocks depicted in FIGS. 3, 6, 9, 13 and 14, for example, can execute on one or more distinct computer systems 1500. Furthermore, all of the steps of the flowcharts depicted in FIGS. 4, 5, 7, 8, and 10-12 can be implemented on one or more distinct computer systems 1500.

Computer system 1500 includes one or more processors, such as processor 1504. Processor 1504 can be a special purpose or a general purpose digital signal processor. Processor 1504 is connected to a communication infrastructure 1502 (for example, a bus or network). Various software implementations are described in terms of this exemplary computer system. After reading this description, it will become apparent to a person skilled in the relevant art(s) how to implement the invention using other computer systems and/or computer architectures.

Computer system 1500 also includes a main memory 1506, preferably random access memory (RAM), and may also include a secondary memory 1520. Secondary memory 1520 may include, for example, a hard disk drive 1522 and/or a removable storage drive 1524, representing a floppy disk drive, a magnetic tape drive, an optical disk drive, or the like. Removable storage drive 1524 reads from and/or writes to a removable storage unit 1528 in a well known manner. Removable storage unit 1528 represents a floppy disk, magnetic tape, optical disk, or the like, which is read by and written to by removable storage drive 1524. As will be appreciated by persons skilled in the relevant art(s), removable storage unit 1528 includes a computer usable storage medium having stored therein computer software and/or data.

In alternative implementations, secondary memory 1520 may include other similar means for allowing computer programs or other instructions to be loaded into computer system 1500. Such means may include, for example, a removable storage unit 1530 and an interface 1526. Examples of such means may include a program cartridge and cartridge interface (such as that found in video game devices), a removable memory chip (such as an EPROM, or PROM) and associated socket, a thumb drive and USB port, and other removable storage units 1530 and interfaces 1526 which allow software and data to be transferred from removable storage unit 1530 to computer system 1500.

Computer system 1500 may also include a communications interface 1540. Communications interface 1540 allows software and data to be transferred between computer system 1500 and external devices. Examples of communications interface 1540 may include a modem, a network interface (such as an Ethernet card), a communications port, a PCMCIA slot and card, etc. Software and data transferred via communications interface 1540 are in the form of signals which may be electronic, electromagnetic, optical, or other signals capable of being received by communications interface 1540. These signals are provided to communications interface 1540 via a communications path 1542. Communications path 1542 carries signals and may be implemented using wire or cable, fiber optics, a phone line, a cellular phone link, an RF link and other communications channels.

As used herein, the terms "computer program medium" and "computer readable medium" are used to generally refer to tangible storage media such as removable storage units 1528 and 1530 or a hard disk installed in hard disk drive 1522. These computer program products are means for providing software to computer system 1500.

Computer programs (also called computer control logic) are stored in main memory 1506 and/or secondary memory 1520. Computer programs may also be received via communications interface 1540. Such computer programs, when executed, enable the computer system 1500 to implement the present invention as discussed herein. In particular, the computer programs, when executed, enable processor 1504 to implement the processes of the present invention, such as any of the methods described herein. Accordingly, such computer programs represent controllers of the computer system 1500. Where the invention is implemented using software, the software may be stored in a computer program product and loaded into computer system 1500 using removable storage drive 1524, interface 1526, or communications interface 1540.

In another embodiment, features of the invention are implemented primarily in hardware using, for example, hardware components such as application-specific integrated circuits (ASICs) and gate arrays. Implementation of a hardware state machine so as to perform the functions described herein will also be apparent to persons skilled in the relevant art(s).

G. Conclusion

While various embodiments of the present invention have been described above, it should be understood that they have been presented by way of example only, and not limitation. It will be understood by those skilled in the relevant art(s) that various changes in form and details may be made to the embodiments of the present invention described herein without departing from the spirit and scope of the invention as defined in the appended claims. Accordingly, the breadth and scope of the present invention should not be limited by any of the above-described exemplary embodiments, but should be defined only in accordance with the following claims and their equivalents.

What is claimed is:

1. A method for encoding an audio signal comprising a series of temporally ordered segments, comprising:

determining, using a processing unit or an integrated circuit, if instantaneous coding or differential coding should be applied to encode a pitch period associated with a current segment of the audio signal by determining if a number of bits required to differentially encode a magnitude of a difference between the pitch period associated with the current segment and a pitch period associated with a previous segment in the series of segments exceeds a number of bits required to instantaneously encode the pitch period associated with the current segment;

determining that instantaneous coding should be applied to encode the pitch period associated with the current segment of the audio signal if the number of bits required to differentially encode the magnitude of the difference between the pitch period associated with the current segment and the pitch period associated with the previous segment exceeds the number of bits required to instantaneously encode the pitch period associated with the current segment;

determining that differential coding should be applied to encode the pitch period associated with the current segment of the audio signal if the number of bits required to differentially encode the magnitude of the difference between the pitch period associated with the current segment and the pitch period associated with the previous segment does not exceed the number of bits required to instantaneously encode the pitch period associated with the current segment;

responsive to determining that instantaneous coding should be applied, outputting a quantized representation of the pitch period associated with the current segment as part of an encoded representation of the current segment; and responsive to determining that differential coding should be applied, encoding the magnitude of the difference between the pitch period associated with the current segment and the pitch period associated with the previous segment and outputting the encoded difference rather than the quantized representation of the pitch period as part of the encoded representation of the current segment.

2. The method of claim 1, wherein encoding the magnitude of the difference between the pitch period associated with the current segment and the pitch period associated with the previous segment comprises:

applying entropy coding to encode the magnitude of the difference.

3. The method of claim 2, wherein applying entropy coding to encode the magnitude of the difference comprises:

applying Huffman coding to encode the magnitude of the difference.

4. The method of claim 3, wherein applying Huffman coding to encode the magnitude of the difference comprises:

selecting one of a plurality of different Huffman codes to represent the magnitude of the difference, wherein each of the plurality of different Huffman codes is of a different length and consists of one or more zeroes followed by a one.

5. The method of claim 1, further comprising:

determining the pitch period associated with the previous segment and the current segment using a pitch period extraction algorithm that operates to smooth a pitch contour associated with the audio signal.

6. The method of claim 5, wherein using a pitch period extraction algorithm that operates to smooth a pitch contour associated with the audio signal comprises:

performing a first-pass pitch period extraction process that extracts first-pass pitch periods associated with the audio signal, the first-pass pitch periods collectively representing a first-pass pitch contour of the audio signal;

storing the first-pass pitch periods; and performing a second-pass pitch period extraction process that utilizes the stored first-pass pitch periods and the audio signal to obtain second-pass pitch periods associated with the audio signal, the second-pass pitch periods collectively representing a smoothed version of the first-pass pitch contour.

7. The method of claim 6, wherein performing the second-pass pitch period extraction process to obtain second-pass pitch periods associated with the audio signal comprises enforcing a constraint upon the size of a difference between a pitch period associated with two adjacent segments of the audio signal.

8. A system, comprising:

a processor; and a memory that stores computer programs for execution by the processor, the computer programs including:

an encoder that when executed by the processor generates an encoded representation of each of a series of temporally-ordered segments that comprise an audio signal by selectively applying either instantaneous coding or differential encoding to encode a pitch period associated with each segment based on whether a number of bits required to differentially encode a magnitude of a difference between a pitch period associated with a current segment and a pitch period associated with a previous segment in the series of segments exceeds a number of bits required to instantaneously encode the pitch period associated with the current segment, wherein the selectively applying comprises applying instantaneous coding to encode the pitch period associated with the current segment of the audio signal if the number of bits required to differentially encode the magnitude of the difference between the pitch period associated with the current segment and the pitch period associated with the previous segment exceeds the number of bits required to instantaneously encode the pitch period associated with the current segment and applying differential coding to encode the pitch period associated with the current segment of the audio signal if the number of bits required to differentially encode the magnitude of the difference between the pitch period associated with the current segment and the pitch period associated with the previous segment does not exceed the number of bits required to instantaneously encode the pitch period associated with the current segment;

wherein, when instantaneous coding is applied to encode the pitch period associated with the current segment of the audio signal, the encoder outputs a quantized representation of the pitch period associated with the current segment as part of an encoded representation of the current segment; and wherein, when differential coding is applied to encode the pitch period associated with the current segment of the audio signal, the encoder encodes the magnitude of the difference between the pitch period associated with the current segment and the pitch period associated with the previous segment and outputs the encoded difference rather than the quantized representation as part of the encoded representation of the current segment.

9. The system of claim 8, wherein the encoder encodes the magnitude of the difference between the pitch period associated with the current segment and the pitch period associated with the previous segment by applying entropy coding to encode the magnitude of the difference.

10. The system of claim 9, wherein the encoder applies entropy coding to encode the magnitude of the difference by applying Huffman coding to encode the magnitude of the difference.

11. The system of claim 10, wherein the encoder applies Huffman coding to encode the magnitude of the difference by selecting one of a plurality of different Huffman codes to represent the magnitude of the difference, wherein each of the plurality of different Huffman codes is of a different length and consists of one or more zeroes followed by a one.

12. The system of claim 8, wherein the encoder determines the pitch period associated with the previous segment and the current segment using a pitch period extraction algorithm that operates to smooth a pitch contour associated with the audio signal.

13. The system of claim 12, wherein the encoder uses the pitch period extraction algorithm that operates to smooth a pitch contour associated with the audio signal by:

performing a first-pass pitch period extraction process that extracts first-pass pitch periods associated with the audio signal, the first-pass pitch periods collectively representing a first-pass pitch contour of the audio signal;

storing the first-pass pitch periods; and performing a second-pass pitch period extraction process that utilizes the stored first-pass pitch periods and the audio signal to obtain second-pass pitch periods associated with the audio signal, the second-pass pitch periods collectively representing a smoothed version of the first-pass pitch contour.

14. The system of claim 13, wherein the encoder performs the second-pass pitch period extraction process to obtain second-pass pitch periods associated with the audio signal by enforcing a constraint upon the size of a difference between a pitch period associated with two adjacent segments of the audio signal.

15. A non-transitory computer program product comprising a computer-readable storage medium having control logic recorded thereon, the control logic being executable by a processing unit to cause the processing unit to perform steps for encoding an audio signal comprising a series of temporally ordered segments, the steps comprising:

determining, using the processing unit, if instantaneous coding or differential coding should be applied to encode a pitch period associated with a current segment of the audio signal by determining if a number of bits required to differentially encode a magnitude of a difference between the pitch period associated with the current segment and a pitch period associated with a previous segment in the series of segments exceeds a number of bits required to instantaneously encode the pitch period associated with the current segment;

determining that instantaneous coding should be applied to encode the pitch period associated with the current segment of the audio signal if the number of bits required to differentially encode the magnitude of the difference between the pitch period associated with the current segment and the pitch period associated with the previous segment exceeds the number of bits required to instantaneously encode the pitch period associated with the current segment;

determining that differential coding should be applied to encode the pitch period associated with the current segment of the audio signal if the number of bits required to differentially encode the magnitude of the difference between the pitch period associated with the current segment and the pitch period associated with the previous segment does not exceed the number of bits required to instantaneously encode the pitch period associated with the current segment;

responsive to determining that instantaneous coding should be applied, outputting a quantized representation of the pitch period associated with the current segment as part of an encoded representation of the current segment; and responsive to determining that differential coding should be applied, encoding the magnitude of the difference between the pitch period associated with the current segment and the pitch period associated with the previous segment and outputting the encoded difference rather than the quantized representation of the pitch period as part of the encoded representation of the current segment.

16. The non-transitory computer program product of claim 15, wherein encoding the magnitude of the difference between the pitch period associated with the current segment and the pitch period associated with the previous segment comprises:

applying entropy coding to encode the magnitude of the difference.

17. The non-transitory computer program product of claim 16, wherein applying entropy coding to encode the magnitude of the difference comprises:

applying Huffman coding to encode the magnitude of the difference by selecting one of a plurality of different Huffman codes to represent the magnitude of the difference, wherein each of the plurality of different Huffman codes is of a different length and consists of one or more zeroes followed by a one.

18. The non-transitory computer program product of claim 15, further comprising:

determining the pitch period associated with the previous segment and the current segment using a pitch period extraction algorithm that operates to smooth a pitch contour associated with the audio signal.

19. The non-transitory computer program product of claim 18, wherein using a pitch period extraction algorithm that operates to smooth a pitch contour associated with the audio signal comprises:

performing a first-pass pitch period extraction process that extracts first-pass pitch periods associated with the audio signal, the first-pass pitch periods collectively representing a first-pass pitch contour of the audio signal;

storing the first-pass pitch periods; and performing a second-pass pitch period extraction process that utilizes the stored first-pass pitch periods and the audio signal to obtain second-pass pitch periods associated with the audio signal, the second-pass pitch periods collectively representing a smoothed version of the first-pass pitch contour.

20. The non-transitory computer program product of claim 19, wherein performing the second-pass pitch period extraction process to obtain second-pass pitch periods associated with the audio signal comprises enforcing a constraint upon the size of a difference between a pitch period associated with two adjacent segments of the audio signal.

* * * * *